US012385220B2

(12) United States Patent
Sato et al.

(10) Patent No.: US 12,385,220 B2
(45) Date of Patent: Aug. 12, 2025

(54) AUTOMATED WORK SYSTEM

(71) Applicant: HITACHI CONSTRUCTION MACHINERY CO., LTD., Tokyo (JP)

(72) Inventors: Hiroaki Sato, Tokyo (JP); Ryu Narikawa, Tokyo (JP); Akira Kanazawa, Tokyo (JP); Shinjirou Yamamoto, Ibaraki (JP); Kouji Shiwaku, Ibaraki (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 136 days.

(21) Appl. No.: 18/023,454

(22) PCT Filed: Dec. 13, 2021

(86) PCT No.: PCT/JP2021/045900
§ 371 (c)(1),
(2) Date: Feb. 27, 2023

(87) PCT Pub. No.: WO2022/168447
PCT Pub. Date: Aug. 11, 2022

(65) Prior Publication Data

US 2023/0332377 A1 Oct. 19, 2023

(30) Foreign Application Priority Data

Feb. 2, 2021 (JP) ..... 2021-014988

(51) Int. Cl.
*E02F 9/20* (2006.01)
*E02F 9/26* (2006.01)

(52) U.S. Cl.
CPC ..... *E02F 9/2054* (2013.01); *E02F 9/205* (2013.01); *E02F 9/262* (2013.01)

(58) Field of Classification Search
CPC . E02F 9/205; E02F 9/2054; E02F 9/26; E02F 9/261; E02F 9/262
See application file for complete search history.

(56) References Cited

U.S. PATENT DOCUMENTS

2004/0158355 A1 8/2004 Holmqvist et al.
2008/0208393 A1* 8/2008 Schricker ..... G08G 1/20 701/1

(Continued)

FOREIGN PATENT DOCUMENTS

JP 5826130 A 2/1983
JP S5826130 A * 2/1983 ..... E02F 3/84

(Continued)

OTHER PUBLICATIONS

Kim et al., Intelligent navigation strategies for an automated earthwork system, 2011, Elsevier (Year: 2011).*

(Continued)

*Primary Examiner* — Russell Frejd
*Assistant Examiner* — Sara J Lewandroski
(74) *Attorney, Agent, or Firm* — MATTINGLY & MALUR, PC

(57) ABSTRACT

An automated operation controller 45 of an automated work system 10 includes: a work status management section 452 that selects a work content according to a work DB 456 that records a work plan for a hydraulic excavator 1 and a work order in the work plan, creates an operation plan based on the selected work content and information on the surrounding environment measured by laser scanners 34, and outputs a control signal to a vehicle body controller 41 based on the operation plan; and an abnormal object detection section 454 that detects an abnormal object present on a work site based on the information on the surrounding environment measured by the laser scanners 34. When the execution of the operation plan is determined to be hindered by the presence (Continued)

of the abnormal object, the work status management section 452 selects another work content from the work plan.

8 Claims, 12 Drawing Sheets

(56) References Cited

U.S. PATENT DOCUMENTS

| | | | | |
|---|---|---|---|---|
| 2020/0018045 | A1 | 1/2020 | Sano et al. | |
| 2020/0159228 | A1* | 5/2020 | Zhong | G05D 1/0088 |
| 2020/0299924 | A1 | 9/2020 | Kurokawa et al. | |
| 2020/0356088 | A1 | 11/2020 | Schlacks, IV et al. | |
| 2020/0362536 | A1 | 11/2020 | Shimamura et al. | |
| 2021/0027634 | A1* | 1/2021 | Li | G08G 5/32 |
| 2021/0034058 | A1* | 2/2021 | Subramanian | G01S 17/86 |
| 2021/0168996 | A1* | 6/2021 | Lee | G05D 1/0278 |
| 2021/0309352 | A1* | 10/2021 | Elkins | E02F 9/261 |
| 2022/0074168 | A1 | 3/2022 | Yamada et al. | |

FOREIGN PATENT DOCUMENTS

| | | | |
|---|---|---|---|
| JP | 2016132912 | A | 7/2016 |
| JP | 2019159727 | A | 9/2019 |
| JP | 2020143481 | A | 9/2020 |
| KR | 2013-0087361 | A | 8/2013 |
| WO | 2018164172 | A1 | 9/2018 |
| WO | 2019167203 | A1 | 9/2019 |

OTHER PUBLICATIONS

Seo et al., Task planner design for an automated excavation system, 2011, Elsevier (Year: 2011).*

International Search Report of PCT/JP2021/045900 dated Feb. 22, 2022.

Extended European Search Report received in corresponding European Application No. 21924832.5 dated Jul. 30, 2024.

Chinese Office Action received in corresponding Chinese Application No. 202180053538.7 dated May 24, 2025.

* cited by examiner

AUTOMATED WORK SYSTEM

TECHNICAL FIELD

The present invention relates to an automated work system, and especially relates to an automated work system that operates a work machine, such as a construction machine, by automated operation. The present application claims priority from Japanese patent application JP 2021-014988 filed on Feb. 2, 2021, the entire content of which is hereby incorporated by reference into this application.

BACKGROUND ART

At a work site for civil engineering, construction, and the like, where a construction machine is used, in order to reduce a task burden of a worker and improve safeness, an automated work system in which the worker and the like outputs instructions and thereby causes the construction machine to operate by automated operation is developed. For example, in Patent Literature 1, a technique that enables an automated operation of a plurality of construction machines by a small number of workers is described.

More specifically, in the technique described in Patent Literature 1, construction position information is output from a construction management section to the respective plurality of construction machines, and thereby the respective plurality of construction machines are caused to operate by automated operation using the construction position information. Thus, by causing the plurality of construction machines to operate by automated operation under the management of the construction management section, a highly efficient construction is made possible even by a small number of workers.

CITATION LIST

Patent Literature

Patent Literature 1: JP 2016-4329U A

SUMMARY OF INVENTION

Technical Problem

However, on a work site, there is a case where an abnormal object, such as a buried object, for example, is excavated and hinders the automated operation of a construction machine. Patent Literature 1 includes a description that, when a situation different from normal occurs while an operator of the construction machine is visually observing the construction range, an operation of stopping the operation of the construction machine or the like is performed according to the situation. That is, both a recognition of the occurrence of the situation different from normal and its handling need to be performed by the operator. Therefore, productivity of the entire operation decreases and becomes a problem.

The present invention has an object to provide an automated work system in which, even when an abnormal object that hinders continuation of work appears, an automated operation of a work machine on a work site can be continued without needing a handling by an operator, and a decrease in productivity can be avoided.

Solution to Problem

An automated work system according to the present invention is an automated work system comprising a surrounding environment measuring device that measures a surrounding environment of a work machine and an automated operation controlling device that controls an automated operation of the work machine. The automated operation controlling device includes a work status management section that selects a work content according to a work order in an obtained work plan, creates an operation plan for the work machine based on the selected work content and information on the surrounding environment measured by the surrounding environment measuring device, and outputs a control signal to a vehicle body controller disposed in the work machine based on the created operation plan, so as to manage a work status of the work machine, and an abnormal object detection section that detects an abnormal object present on a work site where the work plan is executed based on the information on the surrounding environment measured by the surrounding environment measuring device. When an abnormal object is detected by the abnormal object detection section, the work status management section determines whether or not an execution of the operation plan is to be hindered by the presence of the abnormal object, and when the execution of the operation plan is determined to be hindered by the presence of the abnormal object, the work status management section selects another work content from the work plan.

In the automated work system according to the present invention, when an abnormal object is detected, the work status management section of the automated operation controlling device determines whether or not the execution of the operation plan is to be hindered by the presence of the abnormal object, and when the execution of the operation plan is determined to be hindered by the presence of the abnormal object, selects another work content from the work plan. Therefore, even when an abnormal object that hinders continuation of work appears, the work status management section selects another work that is executable, thereby allowing continuation of work by automated operation, and a decrease in productivity can be avoided.

Advantageous Effects of Invention

According to the present invention, even when an abnormal object that hinders continuation of work appears, an automated operation of a work machine on a work site can be continued without needing a handling by an operator, and a decrease in productivity can be avoided.

DESCRIPTION OF EMBODIMENTS

Figure 1:
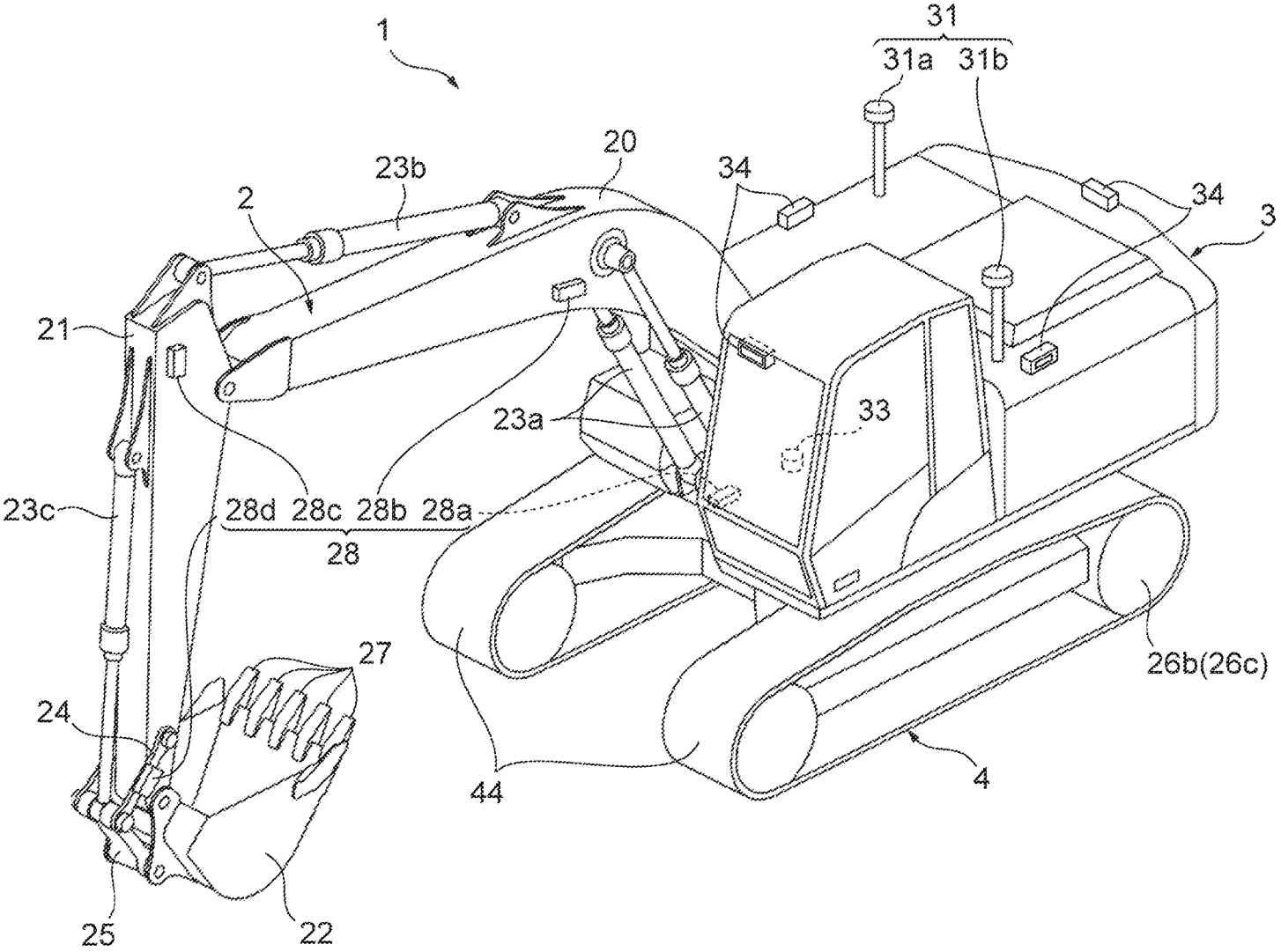
FIG. 1 is a perspective view illustrating a hydraulic excavator.

The following describes embodiments of an automated work system according to the present invention with reference to the drawings. In the descriptions of the drawings, same reference numerals are given to the same elements, and overlapping descriptions will be omitted. The present invention is not limited to these drawings and includes cases where a part of the configuration elements are not used, and the configuration elements of the respective embodiments described in the following can be appropriately combined.

First Embodiment

An automated work system 10 according to the present embodiment is a system mounted on a work machine, for example, to cause the work machine to operate by automated operation. Here, since a description is given using a hydraulic excavator 1 as the work machine, the automated work system 10 of the present embodiment is mounted on the hydraulic excavator 1. Note that, the work machine is not limited to the hydraulic excavator 1, and may be, for example, a wheel loader, a bulldozer, or the like.

[Hydraulic Excavator]

Figure 2:
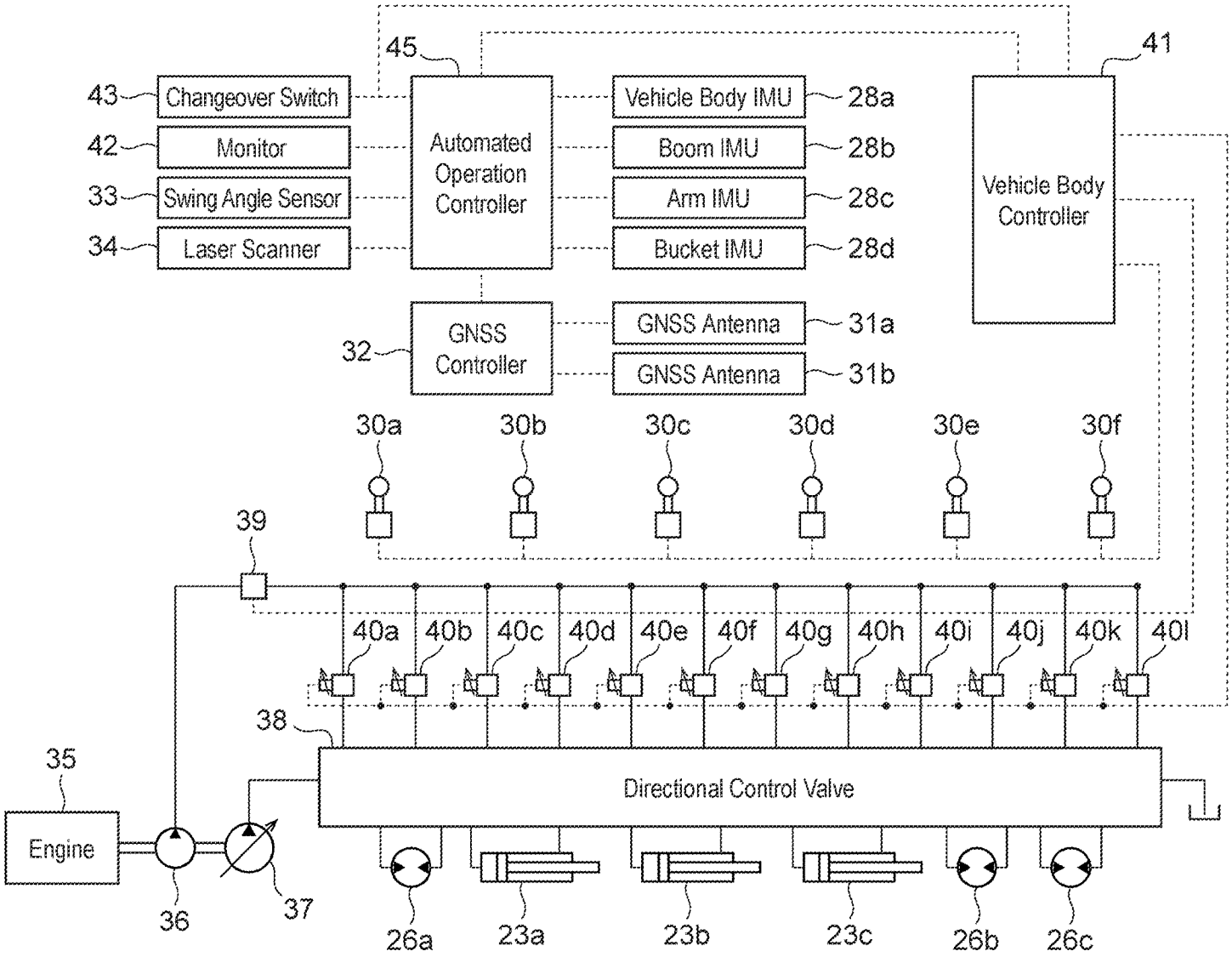
FIG. 2 is a block diagram illustrating a configuration of the hydraulic excavator.

FIG. 1 is a perspective view illustrating a hydraulic excavator, and FIG. 2 is a block diagram illustrating a configuration of the hydraulic excavator. The hydraulic excavator 1 includes a lower traveling body 4 that travels by a power system, an upper swing body 3 installed to be swingable in a right-left direction with respect to the lower traveling body 4, and a working assembly 2 that is installed to the upper swing body 3 and performs work such as excavation. The lower traveling body 4 includes a right-left pair of crawlers 44, and the respective crawlers 44 are driven by hydraulic travel motors 26*b*, 26*c*. The upper swing body 3 is swung driven by a hydraulic swing motor 26*a*. Note that, in the following description, the hydraulic swing motor 26*a* and the hydraulic travel motors 26*b*, 26*c* are collectively referred to as "hydraulic motors 26" in some cases.

The working assembly 2 is configured turnably in a vertical direction with respect to the upper swing body 3. This working assembly 2 includes a boom 20 coupled to the upper swing body 3, an arm 21 coupled to the boom 20, a bucket 22 coupled to the arm 21, boom cylinders 23*a* that drive the boom 20, an arm cylinder 23*b* that drives the arm 21, and a bucket cylinder 23*c* that drives the bucket 22 via first bucket links 24 and a second bucket link 25.

Both ends of the boom cylinders 23*a* are respectively coupled to the upper swing body 3 and the boom 20. The boom 20 turns in the vertical direction with respect to the upper swing body 3 according to an expansion and contraction of the boom cylinders 23*a*. Both ends of the arm cylinder 23*b* are respectively coupled to the boom 20 and the arm 21. The arm 21 turns in a vertical direction with respect to the boom 20 according to the expansion and contraction of the arm cylinder 23*b*.

Both ends of the bucket cylinder 23*c* are respectively coupled to the arm 21 and the first bucket links 24. The first bucket link 24 has one end turnably coupled to the bucket cylinder 23*c*, and the other end turnably coupled to the second bucket link 25. The second bucket link 25 has one end coupled to the first bucket links 24, and the other end turnably coupled to the bucket 22. The arm 21, the first bucket links 24, the second bucket link 25 and the bucket 22 constitute a four-joint link mechanism. When the bucket cylinder 23*c* expands or contracts, the first bucket links 24 relatively turn with respect to the arm 21, and in conjunction with that, the bucket 22 constituting the four-joint link mechanism also turns in the vertical direction with respect to the arm 21.

The hydraulic excavator 1 thus configured drives the boom cylinders 23*a*, the arm cylinder 23*b*, and the bucket cylinder 23*c* to appropriate positions, and thereby can drive the bucket 22 to any position and any posture to perform work such as excavation. The boom cylinders 23*a*, the arm cylinder 23*b*, and the bucket cylinder 23*c* are each configured of a hydraulic cylinder, for example. Note that, in the following description, these cylinders are collectively referred to as "hydraulic cylinders 23" in some cases.

On the upper swing body 3, two Global Navigation Satellite System (GNSS) antennas 31*a*, 31*b* are arranged. GNSS refers to a satellite positioning system that is a global navigation satellite system, which receives signals from a plurality of positioning satellites and obtains its own position on earth. The GNSS antennas 31*a*, 31*b* receive signals (in other words, radio waves) from a plurality of GNSS satellites (not illustrated) positioned in the sky above the earth, and output the received signals to a GNSS controller 32. The GNSS controller 32 computes the positions (such as latitudes, longitudes, and elevations) of the respective GNSS antennas 31*a*, 31*b* on earth based on the signals from the GNSS antennas 31*a*, 31*b*.

Note that, various types of this satellite positioning method exist, and the present invention is not limited to any of these. For example, a method called Real Time Kinematic-GNSS (RTK-GNSS) of receiving correction information from a base station that includes a GNSS antenna located at a site and obtaining its own position with even higher accuracy may be used. In this case, the hydraulic excavator 1 needs a receiver for receiving the correction information from the base station but the own positions of the GNSS antennas 31*a*, 31*b* can be measured with even better accuracy.

By preliminarily locating the arranged positions of the GNSS antennas 31*a*, 31*b* on the upper swing body 3, the position of the upper swing body 3 on earth can be obtained by inversely calculating from arranged positions of the GNSS antennas 31*a*, 31*b*. Further, since the two GNSS antennas 31*a*, 31*b* are both mounted on the upper swing body 3, an orientation (for example, which directions the boom 20, the arm 21, and the bucket 22 are facing) of the upper swing body 3 can also be obtained. Note that, in the following description, the GNSS antennas 31*a*, 31*b* are collectively referred to as "GNSS antennas 31" in some cases.

In addition, a vehicle body Inertial Measurement Unit (IMU) 28*a* for measuring an inclination of the upper swing body 3 is installed to the upper swing body 3. Similarly, a boom IMU 28*b* for measuring an inclination of the boom 20 is installed to the boom 20, an arm IMU 28*c* for measuring an inclination of the arm 21 is installed to the arm 21, and a bucket IMU 28*d* for measuring an inclination of the first bucket link 24 is installed to the first bucket links 24, respectively. Note that, in the following description, these IMUs are collectively referred to as "IMUs 28" in some cases.

The IMUs 28 are sensor units that can measure acceleration rates and angular velocities, and output the results of the measured acceleration rates and angular velocities to an automated operation controller 45 described below. The automated operation controller 45 can obtain postures of the IMUs 28 based on the measured values of the acceleration rates and the angular velocities output from the IMUs 28. That is, the automated operation controller 45 can obtain a forward-backward inclination and a right-left inclination of the upper swing body 3 based on the measurement result of the vehicle body IMU 28*a*, a turning posture of the boom 20 based on the measurement result of the boom IMU 28*b*, and a turning posture of the arm 21 based on the measurement result of the arm IMU 28*c*, respectively.

On the other hand, regarding a tanning posture of the bucket 22, the automated operation controller 45 first obtains turning postures of the first bucket links 24 based on the measurement result of the bucket IMU 28*d*, next computes based on the turning posture of the arm 21 and dimension information on the four-joint link mechanism constituted of the arm 21, the first bucket links 24, the second bucket link 25 and the bucket 22, and thereby can obtain the turning posture of the bucket 22.

Thus, since the position, orientation, forward-backward inclination, and right-left inclination of the upper swing body 3 can be obtained based on the GNSS antenna 31 and the vehicle body IMU 28*a*, it is possible to obtain at which position on earth and in what sort of posture the upper swing body 3 is present. In addition, by having the respective dimension information on the boom 20, the arm 21, the bucket 22, a position of a distal end 27 of the bucket 22 with respect to the upper swing body 3 can be obtained based on these dimension information, and the respective turning postures of the boom 20, the arm 21, and the bucket 22 obtained from the boom IMU 28*b*, the arm IMU 28*c*, and the bucket IMU 28*d*. That is, it is possible to obtain at which position on earth and in what sort of posture the working assembly 2 including the bucket 22 is present. The distal end 27 of the bucket 22 is namely a distal end of the working assembly 2, and will be simply referred to as a "bucket distal end 27" in the following.

The hydraulic excavator 1 further includes a swing angle sensor 33 and laser scanners 34. The swing angle sensor 33 is a sensor that measures a swing angle between the upper swing body 3 and the lower traveling body 4, and is configured of, for example, a rotary encoder and the like. The swing angle sensor 33 outputs its measurement result to the automated operation controller 45.

The laser scanners 34 correspond to the "surrounding environment measuring device" described in the appended claims, and are respectively arranged in the front, back, right, and left directions of the upper swing body 3 to measure the surrounding environment (such as the surrounding terrain and objects) of the hydraulic excavator 1. More specifically, the laser scanners 34 irradiate a constant range in a horizontal direction and a perpendicular direction with a laser light to measure a three-dimensional point cloud data of the terrain and objects around the vehicle body of the hydraulic excavator 1. Then, the laser scanners 34 output the measured information on the surrounding environment to the automated operation controller 45, For example, the laser scanners 34 output the measured three-dimensional point cloud data of around the vehicle body as position information based on the vehicle body to the automated operation controller 45. Thus, by providing the laser scanners 34, the shapes of the terrain and objects around the hydraulic excavator 1 become measurable.

While the IMUS 28 are used to measure the postures of the respective parts of the working assembly 2 in the present embodiment, the present invention is not limited to the BTUs 28, and as long as similar information can be obtained, a potentiometer, a cylinder stroke sensor, and the like may be used. Further, while the laser scanners 34 are used to measure the shapes of the terrain and objects around the vehicle body in the present embodiment, the present invention is not limited to the laser scanners 34, and as long as similar information can be obtained, a stereo camera and the like may be used. When using a stereo camera, three-dimensional orthogonal coordinates are obtained by a triangulation method. Accordingly, calculating three-dimensional polar coordinate systems with measurement centers of the sensors on the respective points as the origins from the arranged positions of the sensors and the obtained orthogonal coordinates can obtain a distance to an object and information on the measured distance.

As illustrated in FIG. 2, the hydraulic excavator 1 further includes an engine 35, a pilot hydraulic pump 36, a main hydraulic pump 37, a directional control valve 38, a shut-off valve 39, control valves 40*a* to 401, and a control lever 30 constituted of an arm control lever 30*a*, a boom control lever 30*b*, a bucket control lever 30*c*, a swing control lever 30*d*, and travel control levers 30*e*, 30*f*, the GNSS controller 32, a vehicle body controller 41, a monitor 42, a changeover switch 43, and the automated operation controller 45. Note that, in the following description, the control valves 40*a* to 401 are collectively referred to as "control valves 40" in some cases.

The pilot hydraulic pump 36 and the main hydraulic pump 37 are each driven by the engine 35 to supply pressure oil into the hydraulic circuit. Here, oil supplied by the pilot hydraulic pump 36 is referred to as pilot oil, and oil supplied by the main hydraulic pump 37 is referred to as hydraulic oil for distinction. The pilot oil supplied from the pilot hydraulic pump 36 passes through the shut-off valve 39 and the control valves 40 to be transmitted to the directional control valve 38. The shut-off valve 39 and the control valves 40 are each electrically connected to the vehicle body controller 41, and the opening and closing of the shut-off valve 39 and the valve opening degree of the control valve 40 can be controlled by the vehicle body controller 41.

The directional control valve 38 controls flow rates and directions of the hydraulic oil supplied from the main hydraulic pump 37 to the respective hydraulic cylinders 23 and the respective hydraulic motors 26, and how much hydraulic oil in which direction is to be flowed to which of the hydraulic cylinders 23 or the hydraulic motors 26 is determined according to the pilot oil having passed through the control valve 40. Specifically, a flow rate of a hydraulic oil that drives the arm cylinder 23*b* in one direction is determined inside the directional control valve 38 according to a pilot oil transmitted to the directional control valve 38 having passed through the control valve 40*a*, and a flow rate of a hydraulic oil that drives the arm cylinder 23*b* in another direction is determined inside the directional control valve 38 according to a pilot oil transmitted to the directional control valve 38 having passed through the control valve 40*b*.

Similarly, a flow rate of a hydraulic oil that drives the boom cylinders 23*a* by a pilot oil having passed through the control valves 40*c*, 40*d*, a flow rate of a hydraulic oil that drives the bucket cylinder 23*c* by a pilot oil having passed through the control valves 40*e*, 40*f*, a flow rate of a hydraulic oil that drives the hydraulic swing motor 26*a* by a pilot oil having passed through the control valves 40*g*, 40*h*, a flow rate of a hydraulic oil that drives the hydraulic travel motor 26*b* by a pilot oil having passed through the control valves 40*i*, 40*j*, and a flow rate of a hydraulic oil that drives the hydraulic travel motor 26*c* by a pilot oil having passed through the control valves 40*k*, 401 are each determined inside the directional control valve 38.

The control lever 30 outputs a voltage or a current according to an operation amount of the respective levers, and is electrically connected to the vehicle body controller 41. The respective operation amounts of the control levers 30 are readable by the vehicle body controller 41.

Here, a basic process for the vehicle body controller 41 to perform a vehicle body operation in a manned operation state will be described. That is, the vehicle body controller 41 receives an operation input from the control lever 30 and first determines in which direction and at how much speeds (in other words, target speeds) the respective actuators (namely, the respective hydraulic cylinders and the respective hydraulic motors) are to be operated.

Next, the vehicle body controller 41 determines the pressure of pilot oil (in other words, a target pilot pressure) supplied to the respective parts of the directional control valve 38 based on the determined direction and target speed. At this time, the vehicle body controller 41 has a conversion map between a pilot pressure and an actuator speed that indicates in which direction and at how much speed the respective actuators operate by how much pilot pressure being supplied to the respective parts of the directional control valve 38, and by applying this, the target speed can be converted into the target pilot pressure.

Once the target pilot pressure is obtained, the vehicle body controller 41 adjusts the valve opening degree of any of the control valves 40 corresponding to an actuator that is desired to be operated and its direction, and controls such that a pilot pressure for the target flow rate is supplied to the directional control valve 38. At this time, in a case where the valve opening degrees of the control valves 40 are controlled by a current output from the vehicle body controller 41, the vehicle body controller 41 has a conversion map between the current and the pilot pressure that indicates, for example, how much pilot pressure is supplied by flowing how much current to each of the control valves 40, and by applying this, an output current to the control valves 40 can be obtained by the target pilot pressure, and the valve opening degrees of the control valves 40 can be controlled such that the pilot pressure that passes through the control valves 40 becomes a pressure according to the target.

Thus, in the manned operation state, the vehicle body controller 41 controls the valve opening degrees of the control valves 40*a*, 40*b* according to the operation amount of the arm control lever 30*a*, controls the valve opening degrees of the control valves 40*c*, 40*d* according to the operation amount of the boom control lever 30*b*, controls the valve opening degrees of the control valves 40*e*, 40*f* according to the operation amount of the bucket control lever 30*c*, controls the valve opening degrees of the control valves 40*g*, 40*h* according to the operation amount of the swing control lever 30*d*, controls the valve opening degrees of the control valves 40*i*, 40*j* according to the operation amount of the travel control lever 30*e*, and controls the valve opening degrees of the control valves 40*k*, 401 according to the operation amount of the travel control lever 30*f*. Accordingly, by the operator operating each of the respective control levers 30, the arm 21, the boom 20, the bucket 22, the upper swing body 3, the left crawler, and the right crawler can be driven, and by operating the control levers 30, any work such as moving the hydraulic excavator 1 can be executed.

As described above, the vehicle body controller 41 can also control the opening and closing of the valve of the shut-off valve 39, When the shut-off valve 39 closes, supply of the pilot oil to the control valves 40 and the directional control valve 38 is cut off. Accordingly, the respective actuators become unable to operate, and therefore the vehicle body controller 41 can stop the operations of all the actuators with more certainty.

As described above, the GNSS controller 32 computes the position (for example, latitude, longitude, and elevation) of the GNSS antenna 31 on earth based on the signal of the GNSS satellite output from the GNSS antenna 31, and outputs the computed result to the automated operation controller 45.

The changeover switch 43 is a switch for switching the manned operation state (in other words, manual control) and an unmanned automated operation state (in other words, automated control) of the hydraulic excavator 1, and is arranged in at least one of the inside or the outside of a cab in the upper swing body 3, The changeover switch 43 is connected to each of the automated operation controller 45 and the vehicle body controller 41, and the automated operation controller 45 and the vehicle body controller 41 are switched between the manned operation state and the unmanned automated operation state based on a signal obtained from the changeover switch 43.

The monitor 42 corresponds to an "information input device" described in the appended claims, and accepts input from a work administrator, the operator, and the like. Specifically, the monitor 42 is, for example, a touch-panel type input/output device and is arranged in at least one of the inside or the outside of a cab in the upper swing body 3. This monitor 42 is used for inputting a work content of the unmanned automated operation. For example, the work administrator can input the work content (such as excavation and loading, slope shaping, and slope tamping), a working range, a target shape, and the like to the automated operation controller 45 via the monitor 42. In addition, by operating the touch panel of the monitor 42, the work administrator, the operator, and the like can edit a work plan recorded in a work DB 456 (described later).

In addition, the monitor 42 also functions as an "information display device" described in the appended claims, and displays the work content selected by a work status management section 452 and an executing range of the work, information on an abnormal object by which the execution of the operation plan is to be hindered, and the like. For example, the monitor 42 is electrically connected to the work DB 456, obtains the work plan recorded in the work DB 456, and displays a work content currently being executed by the hydraulic excavator 1, its progress status, and the like. In addition, the monitor 42 may display the work plan recorded in the work DB 456 in the form of Table 1 or Table 2 described below. Further, when the work plan recorded in the work DB 456 has terminated, the monitor 42 may display the fact that the work plan has terminated. In addition, the monitor 42 is electrically connected to the work status management section 452 (described later), and obtains and displays information on whether the hydraulic excavator 1 is in the manned operation state or the unmanned automated operation state from the work status management section 452.

Thus, by one monitor 42 functioning as both the "information input device" and the "information display device," the component parts of the automated work system 10 can be reduced, and compactification of the automated work system 10 can be achieved.

The vehicle body IMU 28*a*, the boom IMU 28*b*, the arm IMU 28*c*, the bucket IMU 28*d*, the GLASS controller 32, the swing angle sensor 33, the laser scanners 34, the monitor 42, and the changeover switch 43 are each connected to the automated operation controller 45.

The automated operation controller 45 corresponds to an "automated operation controlling device" described in the appended claims, and controls the automated operation of the hydraulic excavator 1. The automated operation controller 45 is constituted of, for example, a microcomputer made by combining a Central Processing Unit (CPU) that executes a computation, a Read Only Memory (ROM) as a secondary storage device that records a program for the computation, and a Random Access Memory (RANI) as a temporary storage device that saves a computing process and temporal control variables, and performs control regarding the automated operation of the hydraulic excavator 1 by the execution of the stored program. Note that, while, in the present embodiment, the automated operation controller 45 is assumed to be mounted on the hydraulic excavator 1, the automated operation controller 45 may be configured to be arranged outside the hydraulic excavator 1, and be able to communicate with the hydraulic excavator 1 via wireless communication or the like.

In the present embodiment, on a work site 5 on which the hydraulic excavator 1 performs work in the unmanned automated operation state (see FIG. 3), the automated operation controller 45 gives an operation instruction for completing the work plan (described later) to the vehicle body controller 41 and thereby causes the hydraulic excavator 1 to operate by automated operation.

Figure 3:
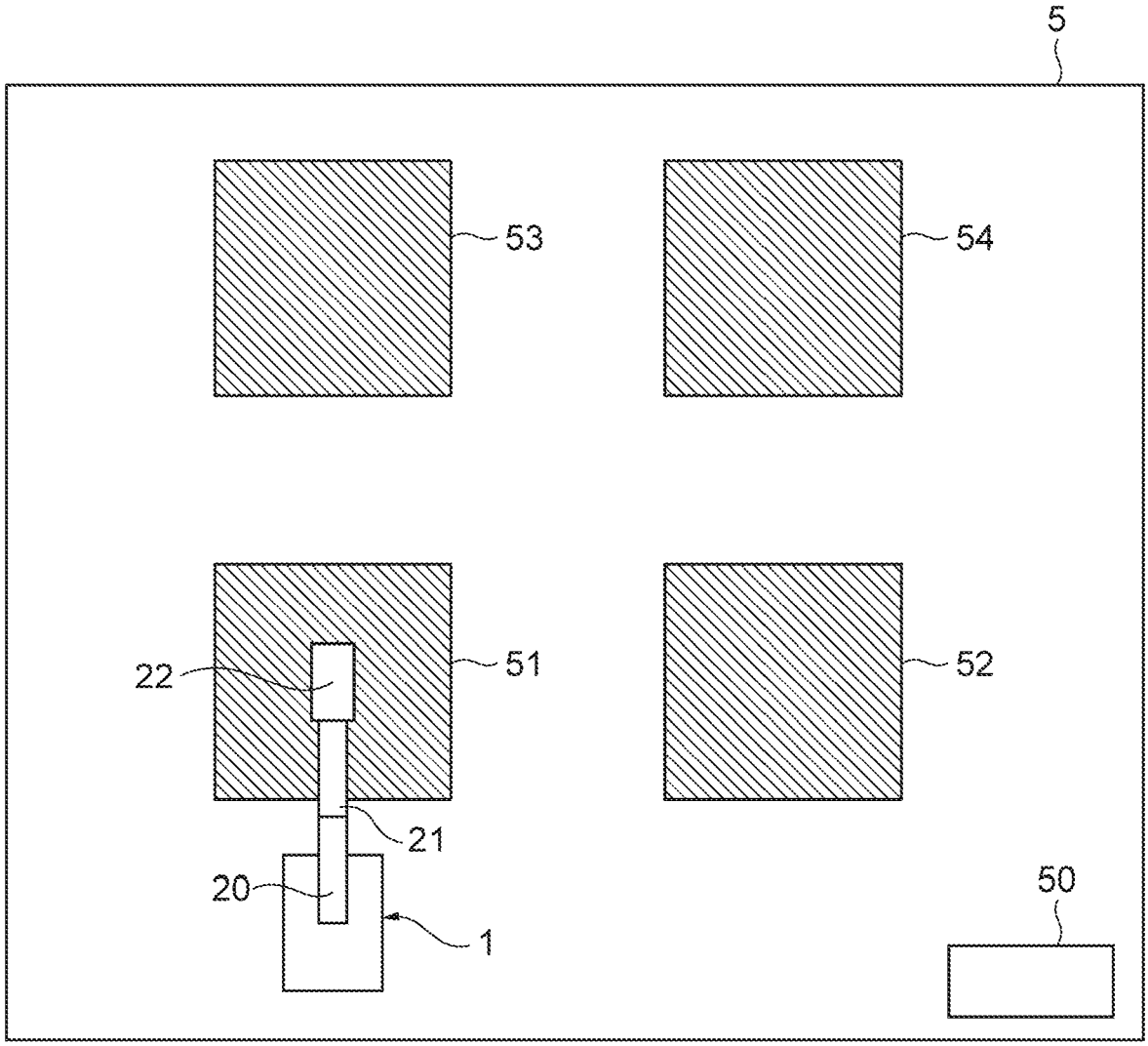
FIG. 3 is a drawing illustrating an exemplary work site of civil engineering.

FIG. 3 illustrates an exemplary work site of civil engineering. As illustrated in FIG. 3, a plurality of excavation areas 51 to 54 exist on the work site 5. The excavation areas 51 to 54 are regions in which the hydraulic excavator 1 digs dirt by performing excavation. In the excavation areas 51 to 54, a three-dimensional terrain shape desired to be created after the excavation by the hydraulic excavator 1 is defined in the work plan as a designed terrain 6 (see FIG. 6). The work plan describes an excavation order such as in what order the hydraulic excavator 1 excavates the plurality of excavation areas 51 to 54.

On the work site 5, the hydraulic excavator 1 first drives the boom cylinders 23*a*, the arm cylinder 23*b*, and the bucket cylinder 23*c*, and thereby performs excavation to store the dirt into the bucket 22. Next, the hydraulic excavator 1 drives the hydraulic swing motor 26*a* and the hydraulic travel motors 261), 26*c* to move up to a dumping site 50 provided on the work site 5, and further drives the boom cylinders 23*a*, the arm cylinder 23*b* and the bucket cylinder 23*c* to dump the dirt inside the bucket 22 to the dumping site 50.

Figure 4:
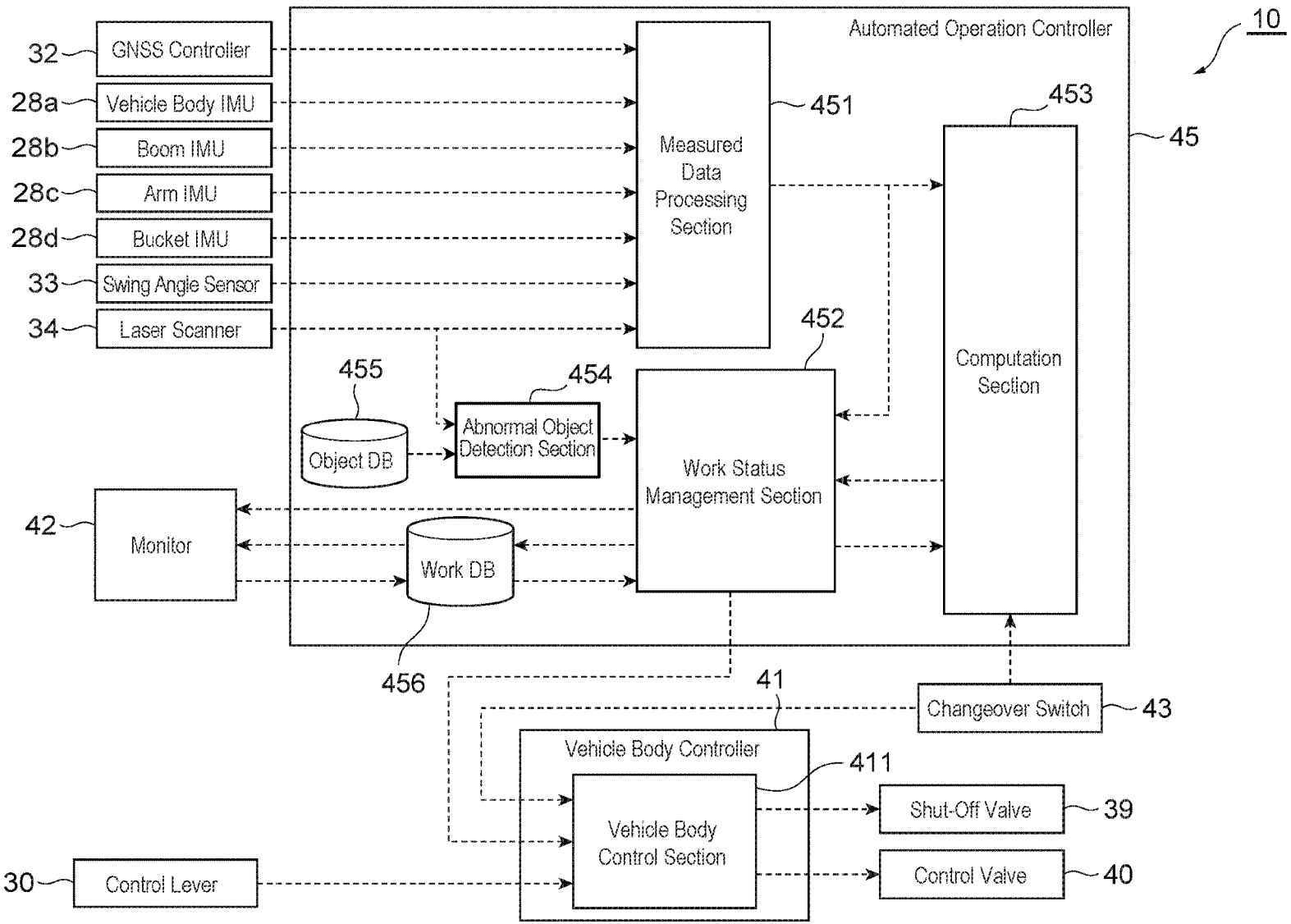
FIG. 4 is a block diagram illustrating a configuration of an automated work system in a first embodiment.

FIG. 4 is a Hock diagram illustrating a configuration of the automated work system in the first embodiment. The automated work system 10 in the present embodiment is constituted of the laser scanners 34, the vehicle body controller 41, the monitor 42, the changeover switch 43, and the automated operation controller 45, described above. The automated operation controller 45 includes a measured data processing section 451, the work status management section 452, a computation section 453, an abnormal object detection section 454, an object Data Base (DB) 455, and the work Data. Base (DB) 456. Meanwhile, the vehicle body controller 41 is configured including a vehicle body control section 411.

[Measured Data Processing Section]

The measured data processing section 451 is electrically connected to each the IMUs 28, the GNSS controller 32, the swing angle sensor 33, and the laser scanners 34, and the measured data processing section 451, based on information from the IMUs 28, the GNSS controller 32, the swing angle sensor 33, and the laser scanners 34, computes the tilting angle, position, orientation, and swing angle of the upper swing body 3; the turning postures of the respective parts of the working assembly 2, and the current terrain of around the vehicle body.

Specifically, the automated operation controller 45, based on the measurement results of the acceleration rate and angular velocity from the respective IMUs 28, computes each the forward-backward inclination and right-left inclination of the upper swing body 3, the turning posture of the boom 20, the turning posture of the arm 21, and the turning posture of the bucket 22. For example, regarding the measurement results from the IMUs 28, the automated operation controller 45 uses, for example, a complementary filter or a Kalman filter, which uses information such as an angle according to an integral process of an angular velocity or an angle formed with the gravity direction according to an obtained gravitational acceleration rate to obtain three-dimensional angles with respect to the gravity direction of the IMUs 28 themselves, and by preliminarily calibrating installation postures of the respective IMUs 28 with respect to respective installation parts of the hydraulic excavator 1, obtains the turning postures of the upper swing body 3, the boom 20, the arm 21, and the first bucket links 24 from the tilting angles of the respective BTUs 28 themselves, and further, as described above, obtains the turning posture of the bucket 22 from the turning postures of the arm 21 and the first bucket links 24.

In addition, the automated operation controller 45 obtains the positions (for example, latitudes, longitudes, and elevations) of the GNSS antennas 31*a*, 31*b* on earth computed by the GNSS controller 32.

In addition, the automated operation controller 45, based on the measurement result of the swing angle sensor 33, obtains a swing angle between the upper swing body 3 and the lower traveling body 4.

Further, the automated operation controller 45, based on the three-dimensional point cloud data around the vehicle body measured by the laser scanners 34, and information on the arranged positions and the arranged postures of the laser scanners 34 with respect to the upper swing body 3, aggregates the information obtained from the plurality of laser scanners 34 into one three-dimensional point cloud data with the vehicle body as the base. In the present embodiment, four laser scanners 34 are disposed to the upper swing body 3, and by aggregating the information obtained from these laser scanners 34, a three-dimensional point cloud data of the entire surrounding of the vehicle body is measured. Note that, when using a sensor having a sufficient measurement range, it is possible to reduce the number of the laser scanners 34, and the number may be increased for reasons such as to include redundancy.

The measured data processing section 451 uses the arranged positions of the laser scanners 34 on the vehicle body to compute the arranged positions of the laser scanners 34 on the vehicle body in a vehicle body coordinate system. In addition, the measured data processing section 451 uses the arranged positions of the GNSS antenna 31*a*, 31*b* on the vehicle body and their positions on earth, and the arranged positions of the laser scanners 34 on the vehicle body in the vehicle body coordinate system to convert the position information of the three-dimensional point cloud data around the vehicle body obtained from the laser scanners 34 into a global coordinate system as the position information on earth. Further, based on the three-dimensional point cloud data around the vehicle body obtained from the laser scanners 34, the measured data processing section 451 computes the current terrain as the terrain shape data around the hydraulic excavator 1.

Then, the measured data processing section 451 outputs the tilting angle, position, orientation, and swing angle of the upper swing body 3, turning postures of the respective parts of the working assembly, and the computation result of the current terrain around the vehicle body to the computation section 453, In addition, the measured data processing section 451 outputs the computation result of the current terrain around the vehicle body to the work status management section 452.

[Work DB]

The work DB 456 corresponds to a "work recording section" described in the appended claims. A work plan and its progress status are recorded in the work DB 456, The work plan includes a work content, a work order, and the like executed by at least one hydraulic excavator 1. The work content is, for example, excavation and loading, slope shaping, or the like, and regarding the work order, for example, ID numbers are assigned to a plurality of excavation areas, and the work order is determined in the order of the assigned ID numbers. The above-described excavation order is the work order of the excavation work (that is, the work content).

Table 1 is an exemplary work plan recorded in the work DB 456. As indicated in table 1, the work plan includes at least elements such as a "work ID," an "excavation area ID," a "work status," a "remaining work amount" and a "work amount," and elements other than these may also be included.

TABLE 1

| Work ID | Excavation Area ID | Work Status | Remaining Work Amount | Work Amount |
|---|---|---|---|---|
| Work 51 | Excavation Area 51 | Completed | 0% | 1000 |
| Work 52 | Excavation Area 52 | Halted | 55% | 2000 |
| Work 53 | Excavation Area 53 | Not Yet Started | 100% | 3000 |
| Work 54 | Excavation Area 54 | Not Yet Started | 100% | 1500 |
| . . . | . . . | . . . | . . . | . . . |

The "work ID" is an ID for identifying the respective works, and it is assumed in the present embodiment that the works are executed in the ascending order of the number of the "work ID." The "excavation area ID" is an ID for identifying the respective excavation areas 51 to 54, and the designed terrain 6 having a three-dimensional terrain shape desired to be created by the excavation operation of the hydraulic excavator 1 is associated with the "excavation area ID." In the "work status," four states "completed," "halted," "in progress," and "not yet started" exist. The "remaining work amount" is a percentage indicating remaining amounts of the respective works. The "work amount" is an "amount of dirt that needs to be excavated before starting the work until creating the designed terrain."

The "remaining work amount" is a value obtained by dividing the "amount of dirt that needs to be excavated from the current terrain until creating the designed terrain" by the "work amount," and converting the amount into percentage. The "amount of dirt that needs to be excavated from the current terrain until creating the designed terrain" and the "amount of dirt that needs to be excavated before starting the work until creating the designed terrain" are calculated as a volume by the work status management section 452 based on the current terrain. The "work status" of a work whose "remaining work amount" has reached 0% is "completed." The "work status" of a work whose "remaining work amount" is 100% is "not yet started." The "work status" of a work that has been halted without the "remaining work amount" reaching 0% is "halted." The "work status" of a work whose work instruction is being given to the hydraulic excavator 1 is "in progress." These "remaining work amount" and "work status" are also parameters indicating the progress status of the work. Note that, the designed terrain 6 as a three-dimensional terrain shape associated with the "excavation area ID" in the work plan recorded in the work DB 456 is editable via an input to the monitor 42.

[Object DB]

The object DB 455 corresponds to an "object recording section" described in the appended claims, and records at least one of information on a predicted present object that is predicted to be present on the work site 5 or information on an unpredicted present object other than the predicted present object. In the present embodiment, the object DB 455 records information on an abnormal object 7 (namely, the predicted present object) that could become a hinderance element of work when the hydraulic excavator 1 performs the work on the work site 5. Specifically, a things such as a large stone, a water pipe, or a wide range of mud caused by rainfall is considered as the abnormal object 7 that could become a work hinderance element. In addition, the object DB 455 records a three-dimensional point cloud data as a feature value required for detecting the abnormal object 7 by an object detection technique. Note that, the object DB 455 may record information on an abnormal object (namely, the unpredicted present object) that would not become a hinderance element of work when performing the work. Accordingly, it is possible to widely deal with the detection of various abnormal objects.

[Abnormal Object Detection Section]

Based on the measurement results of the laser scanners 34, the abnormal object detection section 454 detects an abnormal object that is present on the work site where the above-described work plan is executed. Specifically, the abnormal object detection section 454 first obtains the three-dimensional point cloud data from the laser scanners 34, and uses point cloud three-dimensional coordinate information to obtain information on the position and shape of the object around the hydraulic excavator 1, Here, the position of the object is a point cloud barycentric coordinate calculated using the three-dimensional coordinates of each point where the detected object was measured. The shape of the object is a rectangular parallelepiped calculated with its depth, width, and height being the distances between a maximum value and a minimum value of the respective X, Y, and Z coordinates from the three-dimensional coordinate of each point. A detection method of the position and shape of the object may be any method that allows obtaining object information from the three-dimensional point cloud, such as, for example, the known Occupancy Grid Map (OGM) method.

Next, the abnormal object detection section 454 acquires object information as the three-dimensional point cloud data recorded in the object DB 455, and performs a detection of an abnormal object by determining whether or not the abnormal object 7 recorded as object information is present in the objects obtained by the laser scanners 34. Specifically, the abnormal object detection section 454 uses, for example, SSD as an object detection technique utilizing Deep Learning and the like, and based on a concordance rate between the three-dimensional point cloud data of the object obtained from the laser scanners 34 and the three-dimensional point cloud data of the acquired object information, detects an abnormal object that is present on the work site 5. For example, when the concordance rate is equal to or greater than a preliminarily set threshold value, the abnormal object detection section 454 detects the object as the abnormal object 7. The abnormal object detection section 454 outputs the position, shape, and type of the detected abnormal object 7 as abnormal object information to the work status management section 452.

[Computation Section]

The computation section 453 is electrically connected to the measured data processing section 451, and obtains the tilting angle, position, orientation, and swing angle of the upper swing body 3, postures of the respective parts of the working assembly, and computation result of the current terrain from the measured data processing section 451. This computation section 453 also obtains whether the hydraulic excavator 1 is in the manned operation state or the unmanned automated operation state from the changeover switch 43, and performs processes such as computation according to the manned operation state or the unmanned automated operation state.

For example, when the hydraulic excavator 1 is in the unmanned automated operation state, the computation section 453 obtains the operation plan from the work status management section 452, computes a target trajectory of the lower traveling body 4, a target trajectory of the bucket distal end 27, and target operating speeds of the respective actuators (the respective hydraulic cylinders 23 and the respective hydraulic motors 26) based the obtained operation plan, and outputs the computed result to the work status management section 452. Note that, the operation plan includes at least a ground contact position of the bucket distal end 27 on the current terrain.

Specifically, the computation section 453, based on the computation result obtained from the measured data processing section 451, first computes a target trajectory of the lower traveling body 4 for moving the bucket distal end 27 from its current location to a location where it can be brought into contact with the ground at a specified position included in the operation plan. Next, the computation section 453 computes a target trajectory of the bucket distal end 27 up to when the bucket distal end 27 is moved to a ground contact position specified by the work status management section 452 and dirt is stored inside the bucket 22.

In addition, the computation section 453 computes each a target trajectory of the lower traveling body 4 and a target trajectory of the bucket distal end 27 until the hydraulic excavator 1 dumps dirt in the dumping site 50. Note that, the computation section 453 creates the computed target trajectory of the lower traveling body 4 and target trajectory of the bucket distal end 27 with the global coordinate system as reference. Further, the computation section 453, based on the computed target trajectory of the lower traveling body 4 and target trajectory of the bucket distal end 27, computes the target operating speeds of the respective actuators (the respective hydraulic cylinders 23 and the respective hydraulic motors 26) required for operating the vehicle body. Then, the computation section 453 outputs the computed result to the work status management section 452.

On the other hand, when the hydraulic excavator 1 is in the manned operation state, the computation section 453 does not obtain the operation plan from the work status management section 452, and does not perform the computation of the target trajectory of the lower traveling body 4, the target trajectory of the bucket distal end 27, or the target operating speeds of the respective actuators (the respective hydraulic cylinders 23 and the respective hydraulic motors 26)

[Work Status Management Section]

The work status management section 452 selects a work content according to the work order in the work plan recorded in the work DB 456, and creates the operation plan for the hydraulic excavator 1 based on the selected work content, the measurement result of the laser scanners 34, and the like, so as to manage the work status of the hydraulic excavator 1.

Specifically, the work status management section 452 is electrically connected to each of the abnormal object detection section 454, the work DB 456 and the measured data processing section 451, and obtains the detection result (for example, the abnormal object information) from the abnormal object detection section 454, the work plan from the work DB 456, and the current terrain from the measured data processing section 451. First, the work status management section 452, based on the work plan obtained from the work DB 456, selects a work content, for example, in sequence according to the work order in the work plan. Next, the work status management section 452 creates the operation plan including at least the ground contact position of the bucket distal end 27 regarding the selected work content.

Next, the work status management section 452 outputs the created operation plan to the computation section 453, and instructs the computation section 453 to compute the target trajectory of the bucket distal end 27, the target trajectory of the lower traveling body 4, and the target operating speeds of the respective actuators based on the operation plan. Next, the work status management section 452 obtains the computation results of the target trajectory of the bucket distal end 27, the target trajectory of the lower traveling body 4, and the target operating speeds of the respective actuators from the computation section 453.

In addition, the work status management section 452, based on the detection result (for example, the abnormal object information) obtained from the abnormal object detection section 454, and the target trajectory of the bucket distal end 27 and the target trajectory of the lower traveling body 4 obtained from the computation section 453, determines whether or not the execution of the above-described operation plan is to be hindered by the presence of the abnormal object detected by the abnormal object detection section 454.

When there is no presence of an abnormal object that hinders any of the target trajectory of the bucket distal end 27 or the target trajectory of the lower traveling body 4 on the work site 5, the work status management section 452 determines that the execution of the operation plan is not to be hindered by the presence of the abnormal object. At this time, the work status management section 452 outputs the target operating speeds of the respective actuators (the respective hydraulic cylinders 23 and the respective hydraulic motors 26) obtained from the computation section 453 as work status management information to the vehicle body control section 411 in the vehicle body controller 41. The work status management information here is namely a control signal.

On the other hand, when there is a presence of an abnormal object that hinders at least one of the target trajectory of the bucket distal end 27 or the target trajectory of the lower traveling body 4 on the work site 5, the work status management section 452 determines that the execution of the operation plan is to be hindered by the presence of the abnormal object. At this time, the work status management section 452 instructs the vehicle body control section 411 to halt the work being executed. Next, the work status management section 452 further determines whether or not the halted work (that is, the hindered work) is dividable into a work executed in a "range including the abnormal object" and a work executed in a "range not including the abnormal object."

When the halted work is determined to be dividable into a work executed in the "range including the abnormal object" and a work executed in the "range not including the abnormal object," the work status management section 452 selects a work content in the "range not including the abnormal object," creates a new work plan in the "range not including the abnormal object," and adds the new work plan to the work DB 456. After that, the work status management section 452 outputs the ground contact position of the bucket distal end 27 in the "range not including the abnormal object" as a new operation plan to the computation section 453, and instructs the computation section 453 to compute the target trajectory of the bucket distal end 27, the target trajectory of the lower traveling body 4, and the target operating speeds of the respective actuators based on the operation plan. In other words, the work status management section 452 demands the computation section 453 to compute the target trajectory of the bucket distal end 27, the target trajectory of the lower traveling body 4, and the target operating speeds of the respective actuators (the respective hydraulic cylinders 23, and the respective hydraulic motors 26) for executing the work in the "range not including the abnormal object."

Note that, when there does not exist a work that is executable in the work plan recorded in the work DB 456, the work status management section 452 instructs the vehicle body control section 411 to terminate the work.

In the following, based on FIG. 5 to FIG. 7, an example of dividing an excavation area into a "range including the abnormal object 7" and a "range not including the abnormal object 7" on the work site 5 where the abnormal object 7 has been detected will be described in detail.

Figure 5:
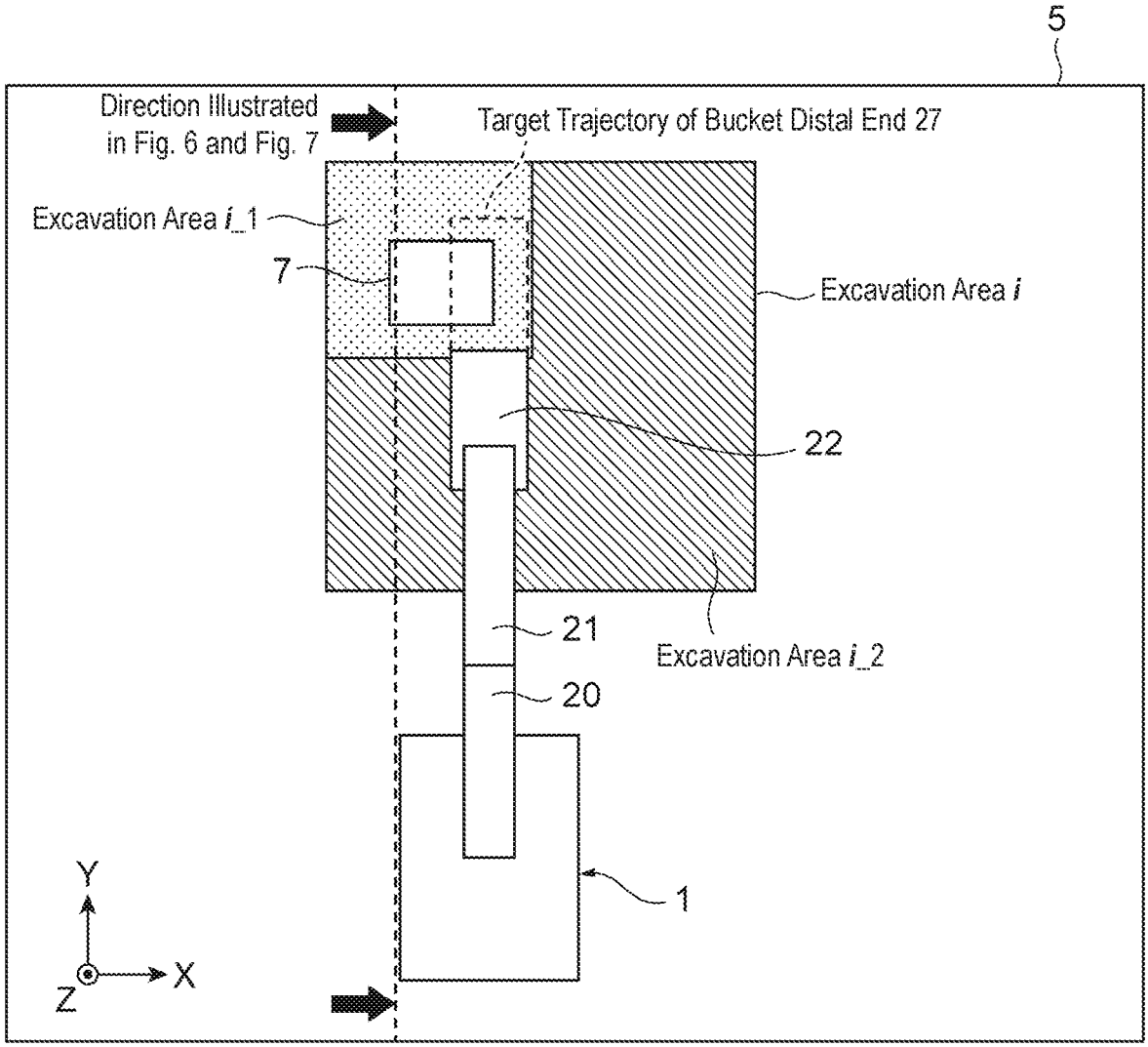
FIG. 5 is a plan view illustrating an exemplary excavation area where an abnormal object has been detected on a work site.
Figure 6:
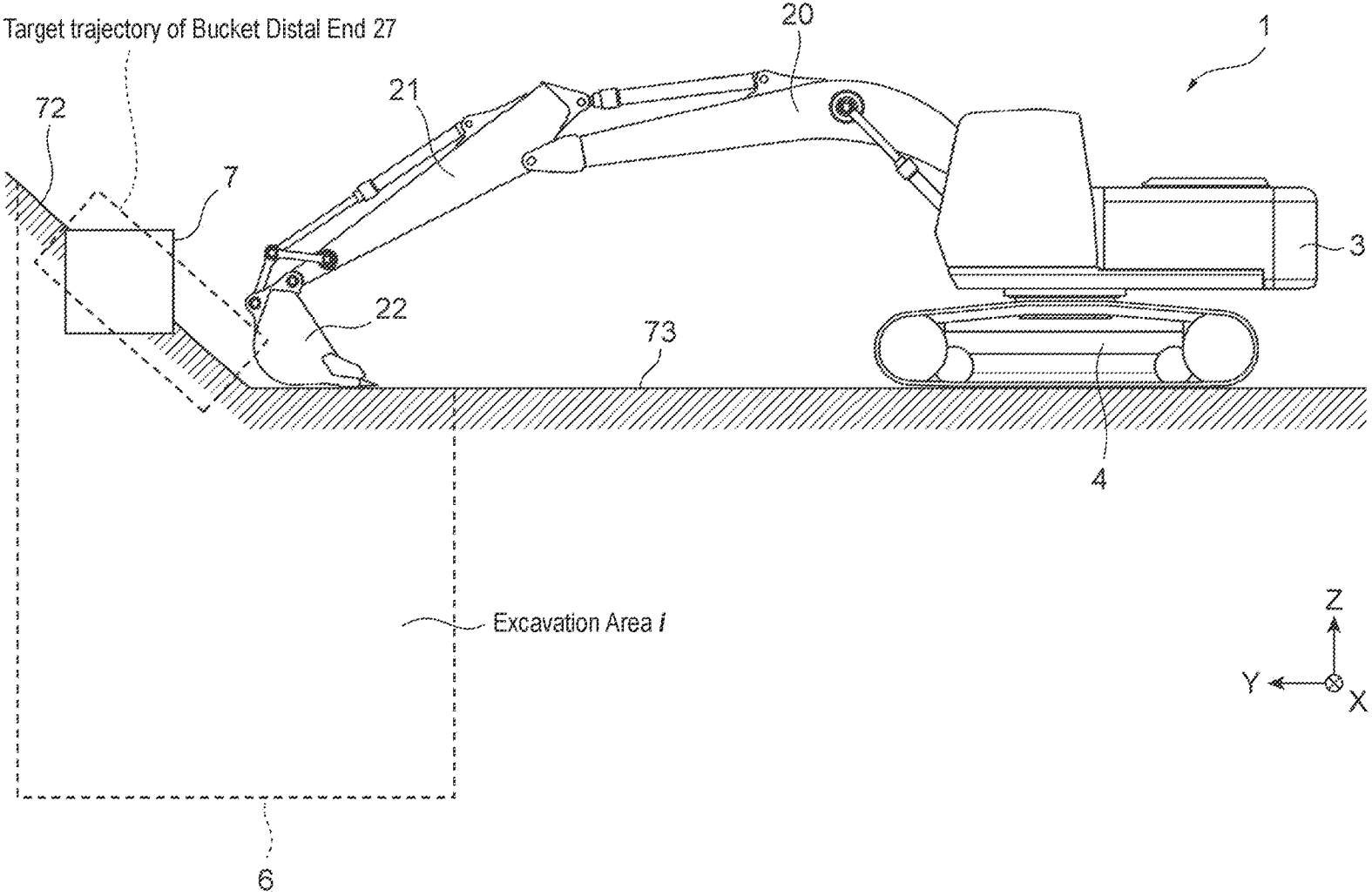
FIG. 6 is a side view illustrating an exemplary excavation area where an abnormal object is detected on a work site.
Figure 7:
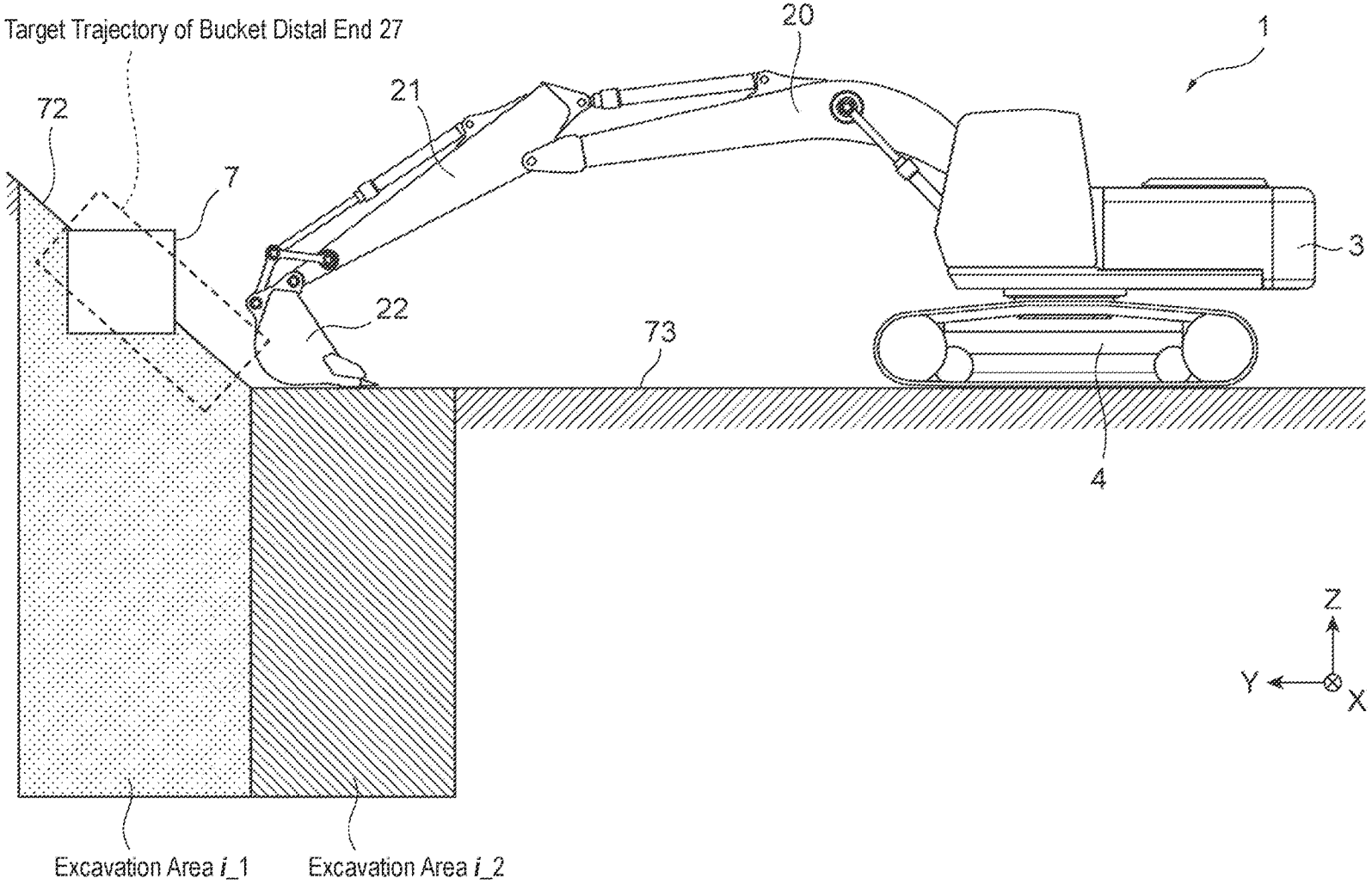
FIG. 7 is a side view illustrating an exemplary excavation area where an abnormal object is detected on a work site.

FIG. 5 to FIG. 7 illustrates an "excavation area i" where the abnormal object 7 has been detected by the abnormal object detection section 454. In FIG. 5 to FIG. 7, by setting a certain point on the work site 5 as the base point, a coordinate system unique to the site in an XYZ space in the illustrated direction is defined, and the respective computation results of the measured data processing section 451 and the respective target trajectories computed by the computation section 453 used in the global coordinate system are each converted to the coordinate system unique to the site.

FIG. 5 is a plan view of the work site 5, and FIG. 6 and FIG. 7 are side views of the work site 5 along the arrow head in FIG. 5. As illustrated in FIG. 6 and FIG. 7, the current terrain of the "excavation area i" is constituted of an inclined surface 72 and a planar surface 73. In the present embodiment, the abnormal object 7 is assumed to be exposed from the inclined surface 72 when the work is started. As illustrated in FIG. 6, in the "excavation area i," excavation until a depth indicated in the designed terrain 6 is executed by the hydraulic excavator 1.

As illustrated in FIG. 5 to FIG. 7, the target trajectory (see dashed line portion in the drawings) of the bucket distal end 27 computed by the computation section 453 in the "excavation area i" overlaps with the position of the abnormal object 7, and the hydraulic excavator 1 is in a state unable to continue the work. Note that, the abnormal object 7 in the present embodiment refers to a thing (for example, a large stone) having a size to the extent of hindering the work of the hydraulic excavator 1, and therefore, even if an abnormal object like a stone that is comparatively small is detected, it does not actually become a hinderance to the work.

In the present embodiment, even when the work cannot be continued because of the abnormal object 7 present on the target trajectory computed by the computation section 453 in the "excavation area 1," the work status management section 452 further divides the "excavation area i" into an "excavation area i_1" as the "range including the abnormal object 7" and the "excavation area i_2" as the "range not including the abnormal object 7," and by commanding the work status management information in the "range not including the abnormal object 7" to the vehicle body control section 411, the work by the hydraulic excavator 1 can be continued.

[Vehicle Body Control Section]

The vehicle body control section 411 controls the operation of the hydraulic excavator 1 based on the operation plan created by the work status management section 452. As illustrated in FIG. 4, the vehicle body control section 411 is electrically connected to the changeover switch 43, and obtains whether the hydraulic excavator 1 is in the manned operation state or the unmanned automated operation state from the changeover switch 43. The vehicle body control section 411 is also electrically connected to the work status management section 452 and obtains the above-described work status management information from the work status management section 452.

When the hydraulic excavator 1 is in the manned operation state, the vehicle body control section 411 drives the control valve 40 to operate the respective actuators according to the operation amount of the control lever 30. On the other hand, when the hydraulic excavator 1 is in the unmanned automated operation state, the vehicle body control section 411 drives the control valve 40 to operate the respective actuators according to the target operating speeds of the respective actuators obtained from the work status management section 452 as the work status management information. When the termination of all the works is output from the work status management section 452, the vehicle body control section 411 immediately stops the operation of the hydraulic excavator 1 or moves the hydraulic excavator 1 to a preliminarily specified position and then stops its operation. Note that, when the termination of all the works is output from the work status management section 452, the vehicle body control section 411 may output the fact that the work plan has terminated on the monitor 42.

Figure 8:
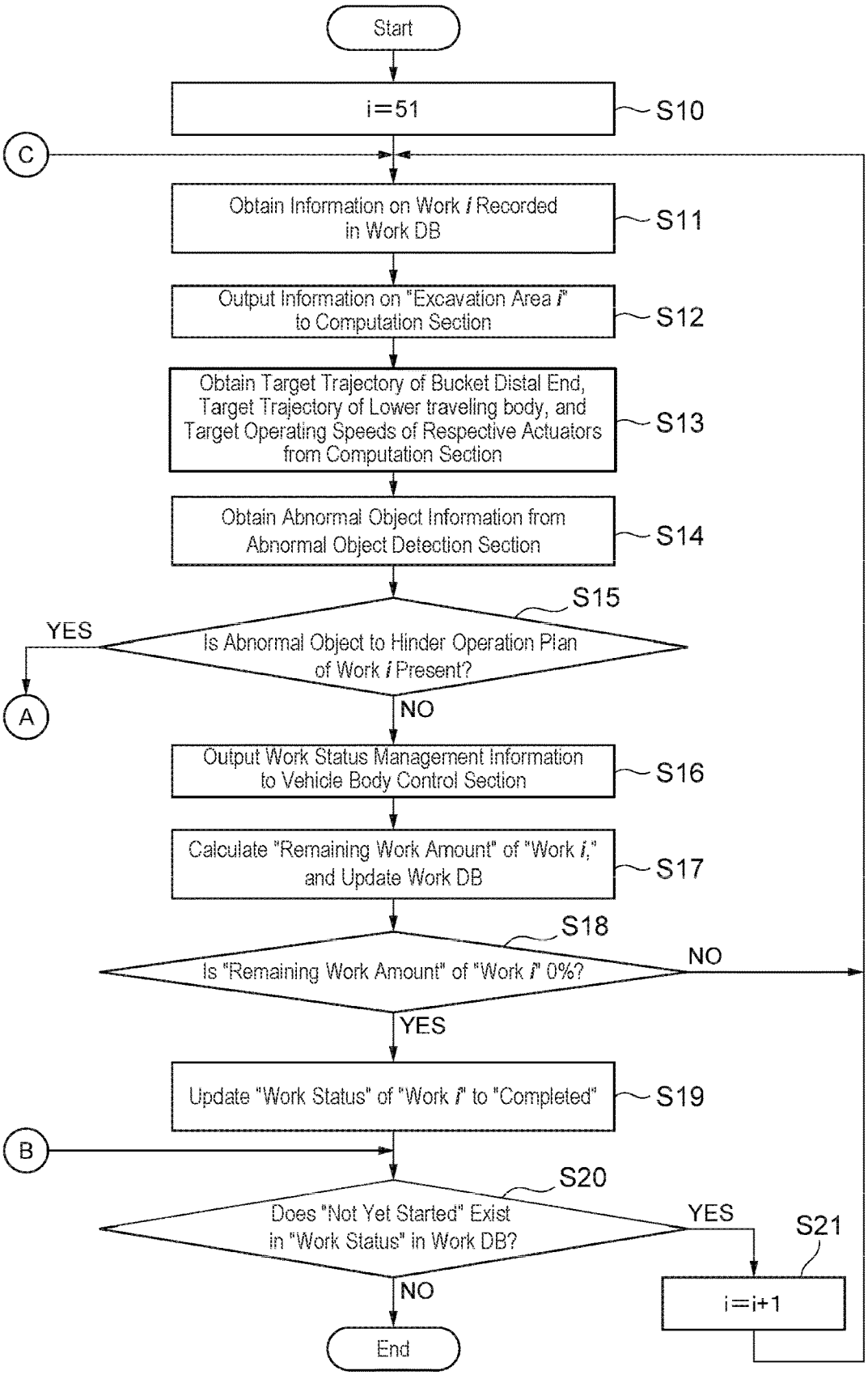
FIG. 8 is a flowchart indicating a control process of an automated operation controller.
Figure 9:
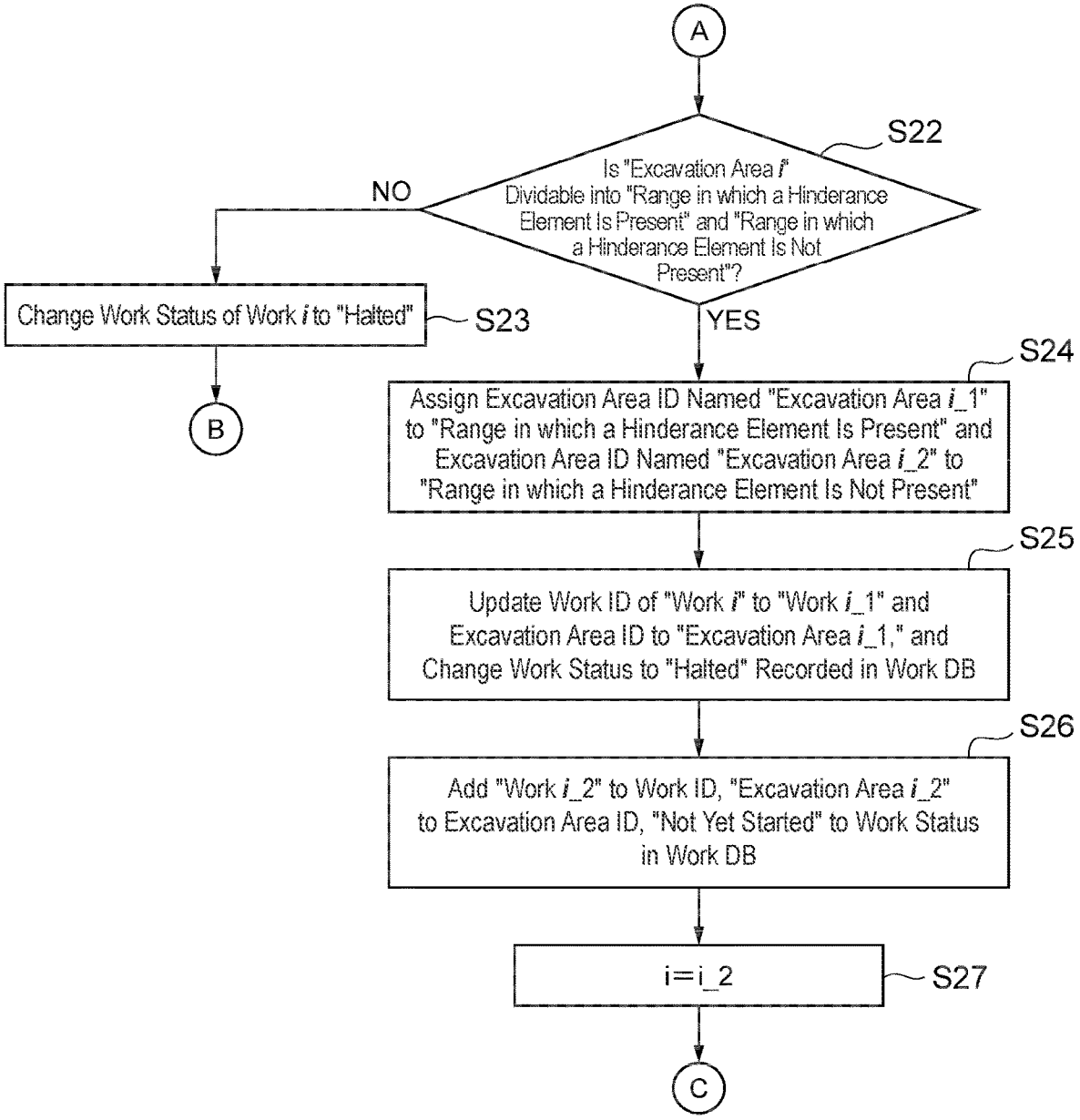
FIG. 9 is a flowchart indicating a control process of the automated operation controller.

In the following, the control process of the automated work system 10 will be described with reference to FIG. 8 and FIG. 9. FIG. 8 is a flowchart indicating step S10 to step S21 of the control process, and FIG. 9 is a flowchart indicating step S22 to step S27 of the control process.

First, in step S10, a work ID number (work i) is assigned. Here, "i" is 51, for example.

In step S11 following step S10, the work status management section 452 obtains information on "work i" from the work plan recorded in the work DB 456. Specifically, the work status management section 452 obtains an "excavation area ID," a "work status," a "remaining work amount," and a "work amount" regarding the work whose work ID is "work i."

In step S12 following step S11, the work status management section 452 outputs information on the "excavation area i" from the obtained information on "work i" to the computation section 453. Specifically, the work status management section 452 outputs a designed terrain associated with the "excavation area i" to the computation section 453. The designed terrain associated with the "excavation area i" is a three-dimensional terrain shape desired to be created by the excavation of the hydraulic excavator 1 from now.

In step S13 following step S12, the work status management section 452 first outputs the created operation plan to the computation section 453, and instructs the computation section 453 to compute the target trajectory of the bucket distal end 27, the target trajectory of the lower traveling body 4, and the target operating speeds of the respective actuators (the respective hydraulic cylinders 23 and the respective hydraulic motors 26) based on the operation plan. Next, the computation section 453 computes each of the target trajectory of the bucket distal end 27, the target trajectory of the lower traveling body 4, and the target operating speeds of the respective actuators based on the operation plan and outputs the computed result, to the work status management section 452, Accordingly, the work status management section 452 obtains the above-described computation result.

In step S14 following step S13, the work status management section 452 obtains the abnormal object information from the abnormal object detection section 454. In step S15 following step S14, the work status management section 452 determines whether or not an abnormal object that is to hinder the operation plan of the "work I" is present. At this time, the work status management section 452, based on a three-dimensional target trajectory of the vehicle body, such as the target trajectory of the bucket distal end 27 and the travel trajectory of the lower traveling body 4 obtained in step S13 and the abnormal object information obtained in step S14, determines whether or not the object (namely, the abnormal object) described in the abnormal object information is present on the three-dimensional target trajectory of the vehicle body.

When an abnormal object is determined to be present on the three-dimensional target trajectory of the vehicle body, the control process proceeds to step S22. For example, as the work site 5 illustrated in FIG. 5, when the abnormal object 7 is present on the target trajectory of the bucket distal end 27 in the site coordinate system unique to the site, the control process proceeds to step S22. On the other hand, when an abnormal object is determined not to be present on the three-dimensional target trajectory of the vehicle body, the control process proceeds to step S16.

In step S16, the work status management section 452 outputs the work status management information to the vehicle body control section 411. Specifically, the work status management section 452 outputs the target operating speeds of the respective actuators obtained in step S13 to the vehicle body control section 411. Then, the vehicle body control section 411 causes the respective actuators to operate according to the target operating speeds of the respective actuators. Accordingly, the hydraulic excavator 1 performs the work by automated operation.

In step S17 following step S16, the work status management section 452 calculates the "remaining work amount" of the "work i" and updates the work DB 456. Specifically, the work status management section 452 calculates the "progress status" of the "work i" from the difference between the designed terrain of the "excavation area i" recorded in the work DB 456 and the three-dimensional information on the current terrain obtained from the measured data processing section 451, and updates the "remaining work amount" of the "work i" recorded in the work DB.

In step S18 following step S17, the work status management section 452 determines whether or not the "remaining work amount" of the "work i" calculated in step S17 has reached 0%. When the "remaining work amount" is determined to have reached 0%, the control process proceeds to step S19, On the other hand, when the "remaining work amount" is determined not to have reached 0%, the control process returns to step S11.

In step S19, the work status management section 452 updates the "work status" of the "work i" recorded in the work DB 456 to "completed."

In step S20 following step S19, the work status management section 452 determines whether or not a work whose "work status" is "not yet started" exists in the work plan stored in the work DB 456. When a work that is "not yet started" is determined to be present, the control process proceeds to step S21. In step S21, it is updated as "i=i+1" (that is, i=52). After that, the control process returns to step S11. On the other hand, when a work whose "work status" is "not yet started" is determined not to be present, the work status management section 452 instructs the termination of all the works to the vehicle body control section 411. Accordingly, one sequence of the control process is terminated.

As described above, when an abnormal object is determined to be present in step S15, the control process proceeds to step S22. In step S22, the work status management section 452 determines whether or not the "excavation area i" is dividable into a "range in which a hinderance element is present" (that is, the range including an abnormal object) and a "range in which a hinderance element is not present" (that is, the range not including an abnormal object). Specifically, the work status management section 452 determines whether or not the "excavation area i" of the "work i" illustrated in FIG. 6 recorded in the work DB 456 into the "excavation area i_1" as the "range including the abnormal object 7" and the "excavation area i_2" as the "range not including the abnormal object 7" as illustrated in FIG. 7.

For example, in the example illustrated in FIG. 7, since the abnormal object 7 has been excavated from the inclined surface 72 of the work site 5, the work status management section 452 divides the "excavation area i" into the inclined surface 72 portion as the "excavation area i_1" and the planar surface 73 portion as the "excavation area i_2" respectively along the Y-axis direction. The "excavation area i_1" as the "range including the abnormal object 7" is cut out as a rectangular range shape having a "constant margin" with respect to the abnormal object 7 on the X-Y coordinate illustrated in FIG. 5, The "constant margin" may be determined based on the type of the abnormal object 7 described in the abnormal object information, or may be preliminarily determined as a constant value in common between all the abnormal objects 7. As a result of cutting out the "excavation area i_1" from the "excavation area i," the "excavation area i_2" as the "range not including the abnormal object 7" is generated in the range illustrated in FIG. 5 and FIG. 7.

Note that, regarding the determination of whether or not the "excavation area i" is dividable into the "excavation area i_1" and "excavation area i_2," for example, a threshold value is preliminarily determined based on the "work amount," and the "excavation area i" is determined to be dividable when the "excavation area i_2" is equal to or greater than the threshold value, and the "excavation area i" is determined to be undividable when the "excavation area i_2" is smaller than the threshold value.

When the "excavation area i" is determined to be undividable in step S22, the process proceeds to step S23. In step S23, the work status management section 452 changes the "work status" of the "work i" to "halted." After that, the control process returns to step S20.

On the other hand, when the "excavation area i" is determined to be dividable in step S22, the control process proceeds to step S24, In step S24, with respect to the "excavation area i" of the "work i" recorded in the work DB 456, the work status management section 452 assigns an excavation area ID named "excavation area i_1" to the "range in which a hinderance element is present" and an excavation area ID named "excavation area i_2" to the "range in which a hinderance element is not present," respectively, That is, the work status management section 452 assigns the excavation area ID named "excavation area i_1" to the "range including the abnormal object 7" and the excavation area. ID named "excavation area i_2" to the "range not including the abnormal object 7," respectively.

In the process here, as indicated in Table 2 below, for example, when the "excavation area 52" is determined to be dividable into an "excavation area 52_1" and an "excavation area 52_2," the work status management section 452 assigns an excavation area. ID "excavation area 52_1" to the "range including the abnormal object 7" and an excavation area ID "excavation area 52_2" to the "range not including the abnormal object 7," respectively.

In step S25 following step S24, the work status management section 452 updates the work ID of the "work i" to "work i_1" and the excavation area ID to "excavation area i_1," and changes the work status to "halted" recorded in the work DB 456. In the process here, as indicated in Table 2 below, for example, the work status management section 452 updates the work ID of the "work 52" recorded in the work DB 456 to a "work 52_1" and the excavation area ID to "excavation area 52_1" and changes the work status to "halted."

In step S26 following step S25, the work status management section 452 adds "work i_2" to the work ID, "excavation area i_2" to the excavation area ID, and "not yet started" to the work status, respectively, of the work DB 456. In the process here, as indicated in Table 2 described below, for example, the work status management section 452 adds "work 52_2" to the work ID, "excavation area 52_2" to the excavation area ID, and "not yet started" to the work status, respectively, of the work DB 456.

TABLE 2

| Work ID | Excavation Area ID | Work Status | Remaining Work Amount | Work Amount |
|---|---|---|---|---|
| Work 51 | Excavation Area 51 | Completed | 0% | 1000 |
| Work 52_1 | Excavation Area 52_1 | Halted | 30% | 500 |
| Work 52_2 | Excavation Area 52_2 | Not Yet Started | 100% | 1500 |
| Work 53 | Excavation Area 53 | Not Yet Started | 100% | 3000 |
| Work 54 | Excavation Area 54 | Not Yet Started | 100% | 1500 |
| . . . | . . . | . . . | . . . | . . . |

In step S27 following step S26, the work ID number (work i) is updated to "i_2." After that, the process returns to step S11.

In the automated work system 10 of the present embodiment, when the abnormal object 7 is detected, the work status management section 452 determines whether or not the execution of the operation plan is to be hindered by the presence of the abnormal object 7, and when the execution of the operation plan is determined to be hindered by the presence of the abnormal object 7, the work status management section 452 further determines whether or not the "excavation area i" is dividable into the "range including the abnormal object 7" and the "range not including the abnormal object 7." When the "excavation area i" is determined to be dividable, the work status management section 452 selects a work in the "range not including the abnormal object 7," creates an operation plan of the selected work, and causes the work of the hydraulic excavator 1 by automated operation to continue. Accordingly, even when the abnormal object 7 that is to hinder the work of the hydraulic excavator 1 appears on the work site 5, the work status management section 452 selects another work that is executable (that is, a work in the "range not including the abnormal object 7") to allow continuation of work by automated operation without needing a handling by the operator, and thus a decrease in productivity can be avoided.

Second Embodiment

In the following, an automated work system of the second embodiment will be described with reference to FIG. 8, FIG. 10, and FIG. 11, While the automated work system of the present embodiment has a configuration similar to that of the first embodiment, it is unlike the first embodiment in the control process. In the following, only the differences from the first embodiment will be described.

That is, in the present embodiment, when the abnormal object 7 that is to hinder the work of the hydraulic excavator 1 is present on the work site 5, the content of the work to be executed by the hydraulic excavator 1 is determined by a selecting operation of the work administrator. In addition, after receiving approval of the work administrator, the work status management section 452 outputs work status management information for continuing the work in the "range not including the abnormal object 7" to the vehicle body control section 411. In addition, according to the selecting operation of the work administrator, the unmanned automated operation state of the hydraulic excavator 1 is switched to the manned operation state. Further, by the hydraulic excavator 1 being switched from the manned operation state to the unmanned automated operation after the abnormal object 7 has been removed from the work site 5 by the work administrator, the work of the hydraulic excavator 1 by automated operation is continued.

The work administrator can by anyone who has acquired the usage of the monitor 42 and the changeover switch 43. In addition, the work administrator may be present in the cab in the upper swing body 3 or in any place inside/outside of the work site 5 that allows monitoring the work of the hydraulic excavator 1. Further, the monitor 42 and the changeover switch 43 may be arranged in any place where they can be visually perceived and operated by the work administrator.

In the control process of the automated work system of the second embodiment, step S10 to step S27 are the same as those in the first embodiment, and step S28 to step S37 are newly added processes. In the following, only the newly added step S28 to step S37 will be described based on FIG. 10, In addition, in the present embodiment, the abnormal object detection section 454 determines whether or not a human is present around the hydraulic excavator 1 based on the measurement results of the laser scanners 34, and when a human is determined to be present, outputs the fact to the work status management section 452.

Figure 10:
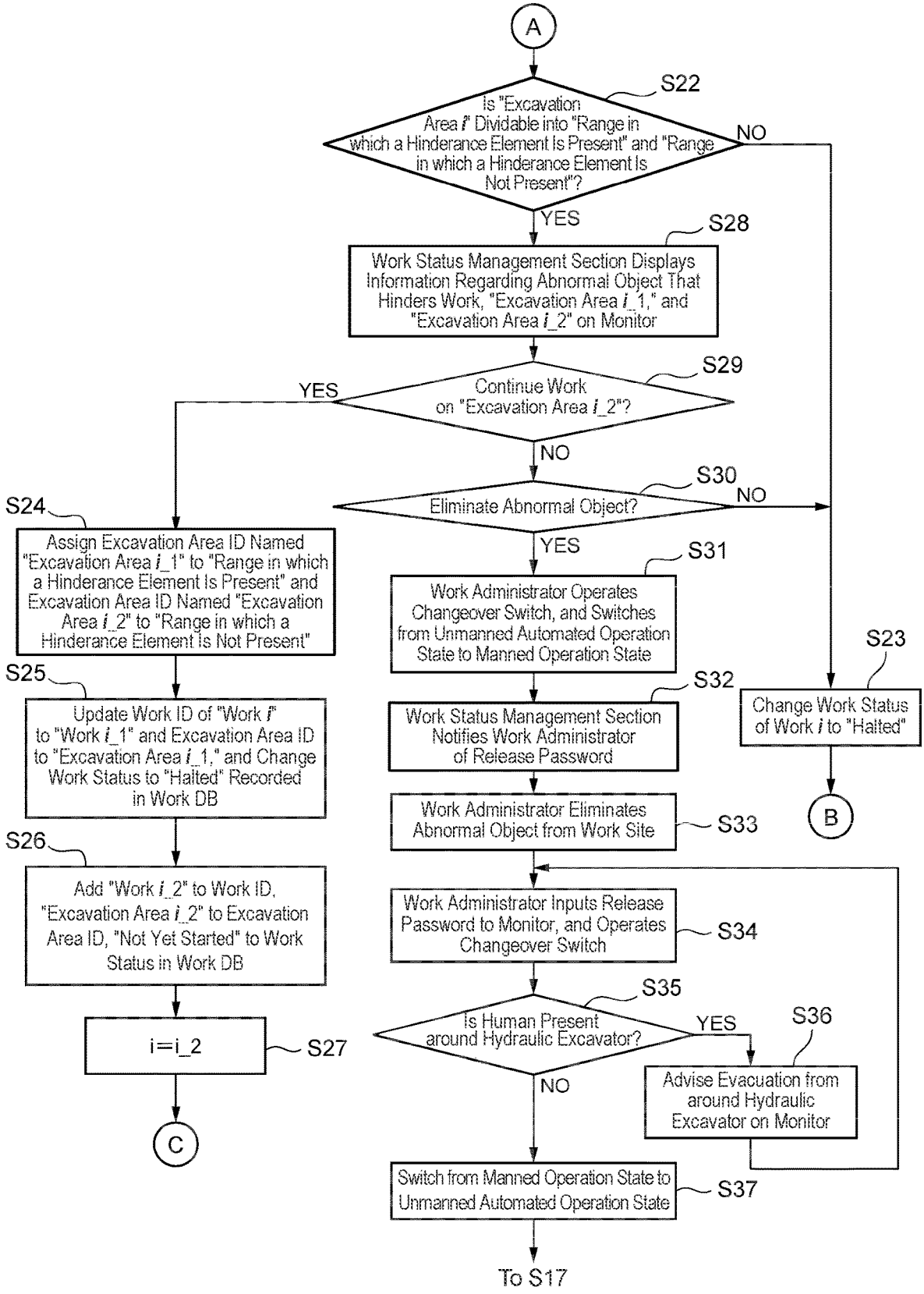
FIG. 10 is a flowchart indicating a control process of an automated operation controller in an automated work system according to a second embodiment.

As indicated in FIG. 10, when the "excavation area i" is determined to be undividable into the "range in which a hinderance element is present" and the "range in which a hinderance element is not present" in step S22, the control process proceeds to step S23 similarly to the first embodiment, and the "work status" of the "work i" is changed to "halted." After that, the control process returns to step S20.

On the other hand, when the "excavation area i" is determined to be dividable into the "range in which a hinderance element is present" and the "range in which a hinderance element is not present" in step S22, the control process proceeds to step S28. In step S28, the work status management section 452 displays the abnormal object information regarding the abnormal object 7 that is to hinder the work on the monitor 42 as indicated in FIG. 11, and thereby notifies the work administrator of the appearance of the abnormal object 7. Further, the work status management section 452 displays the "excavation area i_1" as the "range including the abnormal object 7" and the "excavation area i_2" as the "range not including the abnormal object 7" on the monitor 42 as indicated in FIG. 11 on the monitor 42, and thereby notifies the work administrator of the fact that the "excavation area i" is dividable into the "excavation area i_1" and the "excavation area i_2."

Figure 11:
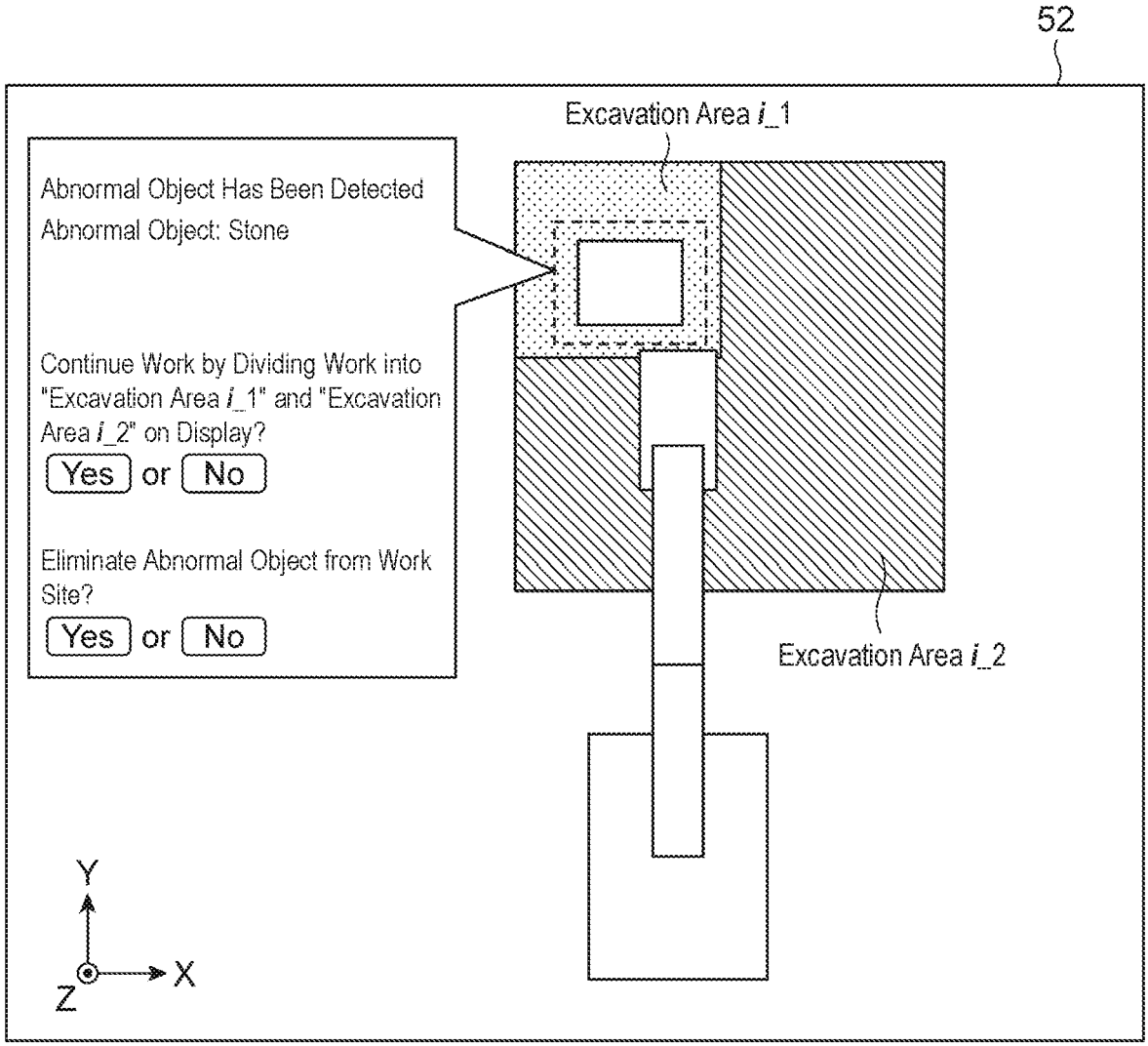
FIG. 11 is an example illustrating a content displayed on a monitor.

In step S29 following step S28, the work administrator selects whether or not to continue the work in the divided "excavation area i_2" via the monitor 42 (see FIG. 11). When it is selected by the work administrator to continue the work, the control process proceeds to the above-described step S24. On the other hand, when it is selected not to continue the work, the process proceeds to step S30.

In step S30, the work administrator selects whether or not to eliminate the abnormal object 7 from the work site 5 via the monitor 42 (see FIG. 11). When it is selected not to eliminate the abnormal object, the control process proceeds to the above-described step S23. On the other hand, when it is selected by the work administrator to eliminate the abnormal object, the control process proceeds to step S31.

In step S31, the work administrator operates the changeover switch 43 to switch the hydraulic excavator 1 from the unmanned automated operation state to the manned operation state. In step S32 following step S31, the work status management section 452 issues a release password of the manned operation state and notifies the work administrator of the release password via the monitor 42.

In step S33 following step S32, the work administrator eliminates the abnormal object 7 from the work site 5. As a method to eliminate the abnormal object 7 from the work site 5, the work administrator may operate the hydraulic excavator 1 by operating the control lever 30, or may be performed by hand work of the work administrator.

In step S34 following step S33, the work administrator inputs the release password of the manned operation state into the monitor 42 and operates the changeover switch 43. In step S35 followed by step S34, the work status management section 452 determines whether or not a human is present around the hydraulic excavator 1 based on the result from the abnormal object detection section 454. When a human is determined to be present, the process proceeds to step S36. In step S36, the work status management section 452 advises the work administrator via the monitor 42 to evacuate the human from around the hydraulic excavator 1 on the monitor 42. After that, the control process returns to step S34.

On the other hand, when a human is determined not to be present in the surroundings in step S35, the control process proceeds to step S37. In step S37, the changeover switch 43 switches the hydraulic excavator 1 from the manned operation state to the unmanned automated operation state. After that, the control process returns to the above-described step S17, and the work of the hydraulic excavator 1 by automated operation is continued.

With the automated work system of the present embodiment, operational advantages similar to those of the above-described first embodiment can be obtained and the following operational advantages are further obtained. That is, when the excavation area is determined to be dividable into the "range including the abnormal object" and the "range not including the abnormal object," in a case where, after the work administrator switches the hydraulic excavator 1 from the unmanned automated operation state to the manned operation state and removes the abnormal object 7 from the work site 5, an instruction for starting the work of the hydraulic excavator 1 is given by the work administrator and a human is not detected around the hydraulic excavator 1, the work status management section 452 selects another work in the work plan and thereby continuation of work by automated operation becomes possible. Accordingly, the work plan described in the work DB 456 can be completely executed and thereby a decrease in productivity can be further avoided.

Third Embodiment

Figure 12:
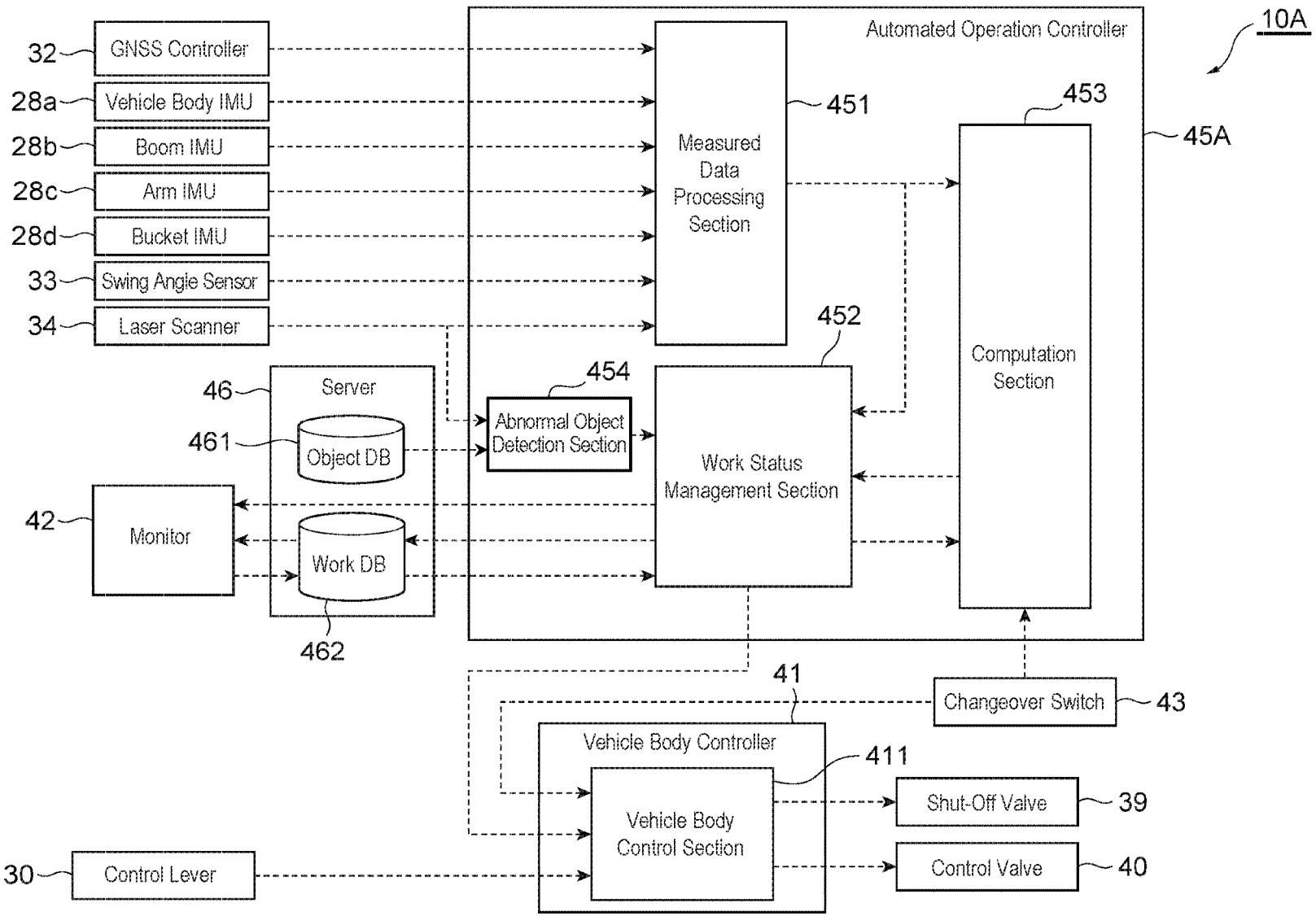
FIG. 12 is a block diagram illustrating a configuration of an automated work system according to a third embodiment.

FIG. 12 is a block diagram illustrating a configuration of an automated work system according to the third embodiment. While an automated work system 100 of the present embodiment is unlike the above-described first embodiment in that an object DB 461 and a work DB 462 are disposed in a server 46, the other configurations are similar to those in the first embodiment.

As illustrated in FIG. 12, in the automated work system 10A of the present embodiment, the object DB 461 and the work DB 462 are independent from an automated operation controller 45A, and disposed in the server 46. The server 46 is, for example, arranged in a management center and is configured to be capable of communicating with the automated operation controller 45. Note that, the object DB 461 has a structure similar to that of the object DB 455 in the first embodiment, and the work DB 462 has a structure similar to that of the work DB 456 in the first embodiment.

With the automated work system 10A of the present embodiment, operational advantages similar to those of the above-described first embodiment can be obtained, and also, since the object DB 461 and the work DB 462 are disposed in the server 46, compactification of the automated operation controller 45A can be achieved.

Note that, while the embodiments indicated up to the present have assumed a situation in which an abnormal object is exposed from the excavation area at the start of work, the automated work system is also applicable to a situation in which an abnormal object is excavated during the excavation by the hydraulic excavator. In addition, while a hydraulic excavator with control levers being mounted inside the work machine has been described, the automated work system is also applicable to a hydraulic excavator with control levers being disposed inside a remote operation room separately from the hydraulic excavator to allow remote operation.

While embodiments of the present invention have been described in detail above, the present invention is not limited to the above-described embodiments, and can be subjected to various kinds of changes of design without departing from the spirit of the present invention described in the appended claims.

REFERENCE SIGNS LIST

1 Hydraulic excavator
2 Working assembly
3 Upper swing body
4 Lower traveling body
10, 10A Automated work system
28*a* Vehicle body IMU
28*b* Boom IMU
28*c* Arm IMU
28*d* Bucket IMU
30 Control lever
31*a*, 31*b* GNSS antenna
32 GNSS controller
33 Swing angle sensor
34 Laser scanner (surrounding environment measuring device)
39 Shut-off valve
40 Control valve
41 Vehicle body controller
42 Monitor (information input device, information display device)
43 Changeover switch
45, 45A Automated operation controller (automated operation controlling device)
46 Server
411 Vehicle body control section
451 Measured data processing section
452 Work status management section
453 Computation section
454 Abnormal object detection section
455 Object DB (object recording section)
456 Work DB (work recording section)
461 Object DB
462 Work DB

The invention claimed is:

1. An automated work system comprising:

a surrounding environment measuring device that measures a surrounding environment of a work machine; and an automated operation controlling device that controls an automated operation of the work machine, wherein the automated operation controlling device includes:

a work status management section that selects, according to a work order in a work plan obtained, a work content from the work plan, creates an operation plan for the work machine on a work site based on the selected work content and information on the surrounding environment measured by the surrounding environment measuring device, and outputs a control signal to a vehicle body controller disposed in the work machine based on the created operation plan, so as to manage a work status of the work machine; and an abnormal object detection section that detects an abnormal object present on the work site where the work plan is executed based on the information on the surrounding environment measured by the surrounding environment measuring device, and when an abnormal object is detected by the abnormal object detection section on the work site, the work status management section determines whether or not an execution of the operation plan is to be hindered by the presence of the abnormal object, and when the execution of the operation plan is determined to be hindered by the presence of the abnormal object, further determines whether or not a hindered work is dividable into a work executed in a range including the abnormal object and a work executed in a range not including the abnormal object by comparing a work amount in the range not including the abnormal object with a preliminarily determined threshold value, and when the hindered work is determined to be dividable, creates the operation plan for the range not including the abnormal object.

2. The automated work system according to claim 1, wherein the work machine includes a traveling body and a working assembly, the automated operation controlling device further includes a computation section that computes a target trajectory of a distal end of the working assembly and a target trajectory of the traveling body based on the operation plan, and when the abnormal object that hinders at least one of the target trajectory of the distal end of the working assembly or the target trajectory of the traveling body computed by the computation section is present, the work status management section determines that the execution of the operation plan is to be hindered by the presence of the abnormal object.

3. The automated work system according to claim 1, further comprising an object recording section that records at least one of information on a predicted present object predicted to be present on the work site or information on an unpredicted present object other than the predicted present object, wherein the object recording section is disposed in the automated operation controlling device or a server.

4. The automated work system according to claim 3, wherein the abnormal object detection section detects an abnormal object present on the work site based on a concordance rate of the information on the surrounding environment measured by the surrounding environment measuring device and the information on an object recorded in the object recording section.

5. The automated work system according to claim 1, further comprising a work recording section that records the work plan, wherein the work plan includes a work content and a work order executed by at least one work machine, and the work recording section is disposed in the automated operation controlling device or a server.

6. The automated work system according to claim 1 further comprising an information display device that displays the work content selected by the work status management section, an executing range of the work, and the information on the abnormal object that is to hinder the execution of the operation plan.

7. The automated work system according to claim 6, further comprising an information input device that accepts input from at least a work administrator, wherein, when the execution of the operation plan is determined to be hindered by the presence of the abnormal object, and continuation of work is instructed by the input to the information input device by the work administrator, the work status management section creates a work plan for the range not including the abnormal object.

8. The automated work system according to claim 7, wherein after the work machine is switched to manual control by the work administrator and the abnormal object is removed from the work site, and when an instruction for starting work of the work machine is given by the work administrator and a human is not detected around the work machine based on the information on the surrounding environment measured by the surrounding environment measuring device, the work status management section selects another work from the work plan.

* * * * *